US008020333B2

(12) United States Patent
Hall et al.

(10) Patent No.: US 8,020,333 B2
(45) Date of Patent: Sep. 20, 2011

(54) CYLINDER WITH POLYCRYSTALLINE DIAMOND INTERIOR

(75) Inventors: David R. Hall, Provo, UT (US); Ronald B. Crockett, Payson, UT (US); Scott Dahlgren, Alpine, UT (US); Timothy C. Duke, Provo, UT (US); Joshua Sensinger, Provo, UT (US); Joe Fox, Spanish Fork, UT (US); Tyson J. Wilde, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/846,794

(22) Filed: Jul. 29, 2010

(65) Prior Publication Data

US 2011/0200840 A1 Aug. 18, 2011

Related U.S. Application Data

(63) Continuation of application No. 11/381,709, filed on May 4, 2006.

(51) Int. Cl.
*F41A 21/02* (2006.01)

(52) U.S. Cl. ..... 42/76.02; 42/76.01; 42/78; 89/14.05; 89/14.7; 89/16

(58) Field of Classification Search ..... 42/76.02, 42/76.01, 77, 78, 76.1; 89/14.05, 16, 14.7, 89/29

See application file for complete search history.

(56) References Cited

U.S. PATENT DOCUMENTS

| | | | | | |
|---|---|---|---|---|---|
| 2,170,259 | A | * | 8/1939 | Borofski | 420/590 |
| 2,609,631 | A | * | 9/1952 | Garand | 42/76.02 |
| 2,849,923 | A | * | 9/1958 | Cotterman | 89/16 |
| 2,850,828 | A | * | 9/1958 | Sullivan | 42/76.02 |
| 2,915,946 | A | * | 12/1959 | Marden | 89/16 |
| 2,975,677 | A | * | 3/1961 | Kelly, Jr. | 89/16 |
| 2,977,666 | A | * | 4/1961 | Brace et al. | 42/78 |
| 3,025,765 | A | * | 3/1962 | Baker | 89/16 |
| 3,571,962 | A | * | 3/1971 | Eig | 42/76.02 |
| 3,753,694 | A | * | 8/1973 | Badia et al. | 420/550 |

(Continued)

OTHER PUBLICATIONS

Refractory Metals, Wikipedia, http://en.wikipedia.org/wiki/Refractory_metals, Mar. 24, 2010.

*Primary Examiner* — James S Bergin
*Assistant Examiner* — Jonathan C Weber
(74) *Attorney, Agent, or Firm* — Brinks Hofer Gilson & Lione

(57) ABSTRACT

A rigid composite structure includes a tubular body made from a metallic material and having a first bore formed therein along a longitudinal axis, and one or more segments formed from a super hard material disposed within the first bore. Each segment has a hole formed in the center thereof, and the segments may be positioned end-to-end and adjacent to one another to align the center holes about the longitudinal axis and form a second bore. The segments can be held under compression within the first bore of the tubular body. The segments may be made of super hard materials such as natural diamond, synthetic diamond, polycrystalline diamond, single crystalline 10 diamond, cubic boron nitrate or other superhard composite materials which exhibit low thermal expansion rates and are generally chemically inert. The resultant rigid composite structure may possess higher tolerances to high pressures and high temperatures within the second bore.

18 Claims, 22 Drawing Sheets

U.S. PATENT DOCUMENTS 4,386,569 A 6/1983 Deas
4,411,672 A 10/1983 Ishizuka
4,435,455 A * 3/1984 Prewo et al. ..... 428/34.5
4,485,721 A * 12/1984 Shankhla et al. ..... 89/15
4,525,178 A 6/1985 Hall
4,577,431 A * 3/1986 Siemers et al. ..... 42/76.02
4,669,212 A * 6/1987 Jackson et al. ..... 42/76.02
4,753,154 A * 6/1988 Higashi ..... 89/14.1
4,802,895 A * 2/1989 Burnand et al. ..... 51/293
4,841,836 A * 6/1989 Bundy ..... 89/14.1
4,982,648 A * 1/1991 Bol et al. ..... 89/14.1
5,125,179 A * 6/1992 Campbell et al. ..... 42/76.02
5,160,802 A * 11/1992 Moscrip ..... 89/16
5,183,958 A * 2/1993 Petrovich ..... 89/16
5,196,637 A * 3/1993 Petrovich ..... 42/76.02
5,212,328 A * 5/1993 Petrovich ..... 42/76.02
5,355,765 A 10/1994 Rogers
5,378,499 A * 1/1995 Martin et al. ..... 427/242
5,462,772 A * 10/1995 Lemelson ..... 427/554
5,600,912 A * 2/1997 Smith ..... 42/76.01
5,657,568 A * 8/1997 Christensen ..... 42/76.02
5,731,046 A * 3/1998 Mistry et al. ..... 427/553
5,804,756 A * 9/1998 Christensen ..... 89/15
5,856,631 A * 1/1999 Julien ..... 89/16
5,915,937 A * 6/1999 Christensen ..... 42/76.02
6,482,248 B1 * 11/2002 Holloway ..... 75/249
6,576,598 B2 * 6/2003 Brown ..... 508/118
6,615,702 B1 * 9/2003 Julien ..... 89/16
6,789,454 B2 * 9/2004 Smith ..... 89/16
6,810,615 B2 11/2004 Hermanson et al.
6,817,550 B2 11/2004 Taylor et al.
7,172,142 B2 2/2007 Taylor et al.
7,197,986 B1 * 4/2007 Calkins ..... 102/529
7,347,259 B2 3/2008 Ravensbergen et al.
2002/0002786 A1 * 1/2002 Smith ..... 42/76.02
2003/0078170 A1 * 4/2003 Brown ..... 508/115
2004/0052964 A1 * 3/2004 Kaufmann ..... 427/446
2004/0140292 A1 * 7/2004 Kelley et al. ..... 219/76.13
2005/0268517 A1 * 12/2005 Withers et al. ..... 42/76.02
2006/0265926 A1 * 11/2006 Sietsema ..... 42/76.02

* cited by examiner

CYLINDER WITH POLYCRYSTALLINE DIAMOND INTERIOR

RELATED APPLICATIONS

This application is a continuation of U.S. patent application Ser. No. 11/381,709, filed on May 4, 2006 and entitled "A Rigid Composite Structure with a Superhard Interior Surface", which is incorporated by reference in its entirely herein.

BACKGROUND OF THE INVENTION

This invention relates to composite structures that retain their structural integrity despite exposure to the wear erosive and/or corrosive effects of sudden high pressures, high-pressure friction forces and high temperatures typically associated with their use, particularly within the interior of the structure. The present invention may be especially adapted for use in gun barrels, piston cylinders, pipes or other composite structures where the retention of structural integrity despite exposure to such brisant forces is an integral component of their ordinary application.

Gun barrels for example, are structures that have typically been constructed of metallic materials that are incorporated to accommodate a projectile or bullet that may then be propelled out of the barrel as a result of an exploding cartridge in the breech end of the structure. During this firing process, brisant forces, including high pressure and elevated temperatures, resulting from the hot gases released from the cartridge and friction and distortion energy created between the bullet and internal circumference of the barrel, are suddenly exerted on the barrel as the bullet travels along and out of the barrel. Gun barrels that are consistently exposed to these brisant forces, such as machine gun barrels that expend hundreds of rounds per minute, are more prone to losing their original structural integrity as the metallic material begins to expand and warp as a result of elevated temperatures exerted on the barrel or the barrel becomes clogged with an accumulation of lead and/or copper that breaks away from projectiles as they exit the barrel. This is of particular concern in gun barrels where the diameter of the barrel expands such that the internal circumference of the barrel no longer holds enough compression to effectively launch a projectile, or the projectile falls short of the desired distance, rendering the gun ineffective. Alternatively, gun barrels have also been known to explode and cause physical injury or death to their operators as a result of deformed, warped or clogged barrels. These concerns have become increasingly significant as advancements have been made in ballistics which have produced higher powered propellants, higher muzzle velocity, higher rates of fire and so forth, making the probability of these phenomena more likely.

In response to these phenomena, many attempts have been made to produce barrels made of tough, high strength materials that can accommodate such advancements and are capable of withstanding the detrimental effects of sudden high pressures and temperatures normally associated in ordinance use. Despite concerted efforts, many of these developments have yet to prove effective in their application because materials that yield high strength characteristics may conversely have very low toughness properties making the barrel brittle and more susceptible to breaking or exploding, while materials that exhibit high toughness properties may conversely exhibit low hardness making them more susceptible to erosion.

BRIEF SUMMARY OF THE INVENTION

The present invention is a rigid composite structure that is resistant to wear and able to retain its structural integrity when exposed to high temperatures and high pressures. This is achieved through the incorporation of high-strength, high-toughness crystalline materials and their subsequent structural arrangement. The structural arrangement and selected materials used serve to enhance the composite structure's low coefficient of thermal expansion, low friction refractory, high hardness, and chemical inert properties which in turn provide better retention of structural integrity and resistance to wear.

The invention comprises a tubular body made from a metallic material and having a first bore formed therein. The metallic material forming the tubular body may comprise of one or more of the following materials, including aluminum, titanium, a refractory metal, steel, stainless steel, Invar 36, Invar 42, Invar 365, a composite, a ceramic, carbon fiber or combinations thereof. In some embodiments, the metallic material may exhibit a low coefficient of thermal expansion. The first bore is formed along a longitudinal axis of the tubular body and encases one or more segments made with a super hard material. Each of the segments has a hole formed in the center thereof, which holes align about the longitudinal axis to form a second bore when the one or more segments are assembled together within the first bore. The tubular body assists to structurally support the segments, and may also be shrink wrapped around the one or more segments to hold the segments under radial compression.

The one or more super hard segments may be arranged co-axially adjacent one another within the first bore of the tubular body. The segments may comprise natural diamond, synthetic diamond, polycrystalline diamond, single crystalline diamond, cubic boron nitride or composite materials. These materials may have low thermal expansion characteristics and are typically chemically inert, which can further enhance the composite structure's ability to retain its structural integrity. The segments may be held in place within the first bore by being interposed between both a shoulder and a biased end of the tubular body, or by brazing each segment together. The brazed material may comprise of gold, silver, a refractory metal, carbide, tungsten carbide, niobium, titanium, platinum, molybdenum, nickel palladium, cadmium, cobalt, chromium, copper, silicon, zinc, lead, manganese, tungsten, platinum or combinations thereof. Alternatively, the one or more segments may be held in place by shrink wrapping the tubular body around the segments, such that the segments are held under radial compression within the first bore and axial compression along the longitudinal axis of the tubular body.

An intermediate material may serve as a transition layer between the tubular body and the one or more super hard segments. The intermediate material may comprise Invar 36, Invar 42, Invar 365, a composite, a ceramic, a refractory metal, carbon fiber or combinations thereof. The transition layer may also serve as a thermal insulator when wrapped in between the tubular body and the segments to reduce thermal expansion of the tubular body and to assist in maintaining the structural integrity of the composite structure. In order to promote metallurgical bonding between the tubular body and the segments, as well as the intermediate material, a binder may be used. The binder may comprise cobalt, nickel, iron, tungsten, tantalum, molybdenum, silicon, niobium, titanium, zirconium, a refractory group metal or combinations thereof.

This new composite structure is capable of withstanding hot, highly corrosive environments while at the same time also being capable of withstanding substantial pressure and structural stresses as a result of continued use and friction, especially within the second bore.

DETAILED DESCRIPTION OF EXEMPLARY EMBODIMENTS

It will be readily understood that the components of the present invention, as generally described and illustrated in the Figures herein, may be arranged and designed in a wide variety of different configurations. Thus, the following, more detailed description of embodiments of the apparatus of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the apparatus described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
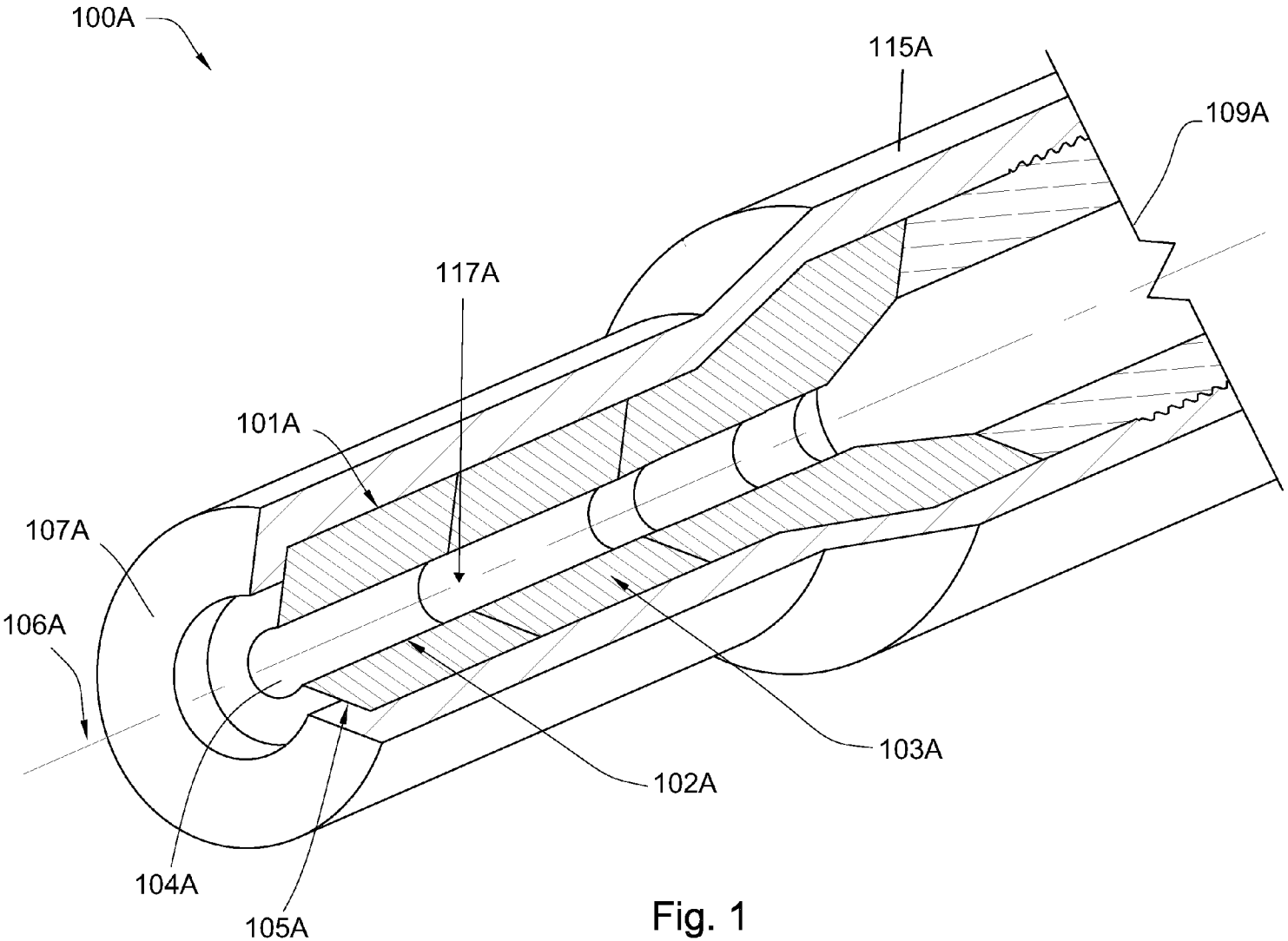
FIG. 1 is a perspective sectional diagram of an embodiment of a rigid composite structure broken away to indicate an indeterminate length.
Figure 2:
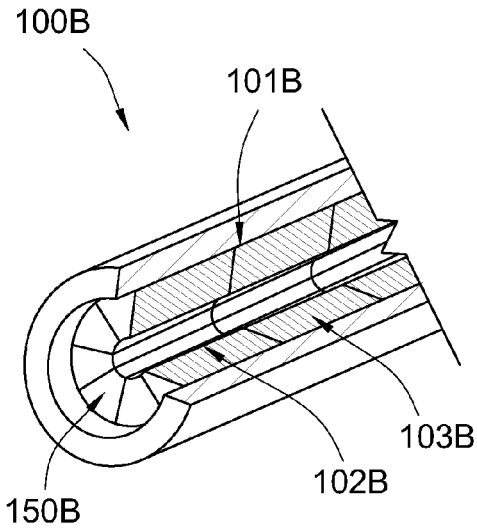
FIG. 2 is a perspective sectional diagram of another embodiment depicting a configuration of the super hard segments.
Figure 3:
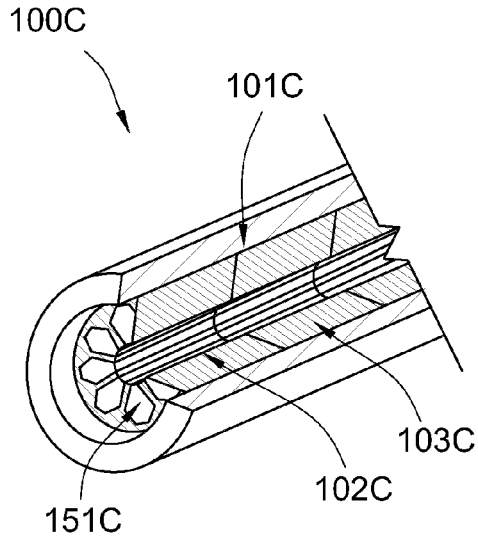
FIG. 3 is a perspective sectional diagram of another embodiment depicting a configuration of the super hard segments.
Figure 4:
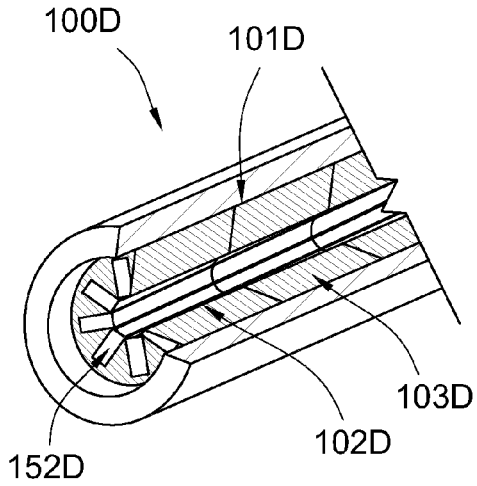
FIG. 4 is a perspective sectional diagram of another embodiment depicting a configuration of the super hard segments.

FIG. 1 is a diagram of an embodiment of a rigid composite structure 100A in accordance with the present invention. The rigid composite structure 100A may comprise a tubular body 115A made from a metallic material and having a longitudinal axis 106A. The tubular body 115A has a first bore 101A formed along the longitudinal axis 106A that is substantially coaxial with a second bore 102A. One or more super hard segments 103A, each having a center hole 117A formed therein, may be disposed within the first bore 101A of the tubular body 115A so that the center holes 117A of the segments 103A align about the longitudinal axis 106A to form the second bore 102A. The one or more super hard composite segments 103A may be interposed adjacent one another coaxially along the longitudinal axis 106A of the first bore 101A. The interior surfaces 104A of the center holes 117A of the segments 103A may be polished to provide a low friction surface as well.

A significant feature of this invention is the second bore 102A, which may be formed by the one or more super hard segments 103A with center holes 117A having a super hard interior surface 104A. The super hard segments 103A may comprise a suitable composite material including but not limited to natural diamond, synthetic diamond, polycrystalline diamond, single crystalline diamond, or cubic boron nitride. This super hard composite material may also incorporate a binder material comprising of cobalt, niobium, titanium, zirconium, nickel, iron, tungsten, tantalum, molybdenum, silicon, a refractory group metal or combinations thereof which may bind together grains of the super hard composite materials in such a way to form the segments 103A.

The interior portion of the segments 103A may comprise a region depleted of the binder material. This may be advantageous when the second bore 102A is subjected to high temperatures since the binder material may have a higher thermal expansion rate than the superhard composite material.

The super hard segments 103A, which may be annular segments, wedge like segments, various geometric shape segments or a combination thereof, may be interposed within the first bore 101A in a concentric array that extends lengthwise along the longitudinal axis 106A of the tubular body 115A.

The super hard composite material forming the segments 103A may be chemically inert and may possess fracture toughness, thermal shock resistance, tensile strength, and low thermal expansion characteristics all of which may serve to further enhance resistance to wear when high pressures or high temperatures are exerted on the interior surfaces 104A of the structure. While not limited thereto, polycrystalline diamond may be the preferred composite material and may possess a plurality of grains comprised of a size of 0.1 to 300 microns. The super hard composite material may also have a thermal expansion coefficient of approximately 2 μin/in, but in some embodiments, the thermal expansion coefficient may be 0.1 to 10 μin/in. This is a significant feature as it enhances the structural integrity of the overall composite structure 100A during periods of high pressure and high temperatures in such applications as a gun barrel, piston cylinder, pipe, tube, or other rigid composite structures that may exert friction on the interior surface. Despite the various forces that may act on the super hard interior surfaces 104A of the center holes 117A which align to form the second bore 102A, the rigid composite structure 100A is able to retain its structural integrity due in part to the inherent characteristics of the super hard segments 103A disposed within the first bore 101A of the tubular body 115A.

The tubular body 115A may be formed in a suitable metallic material, such as Invar 365, that exhibits lower coefficients of thermal expansion at lower temperatures and higher coefficients of thermal expansion at higher temperatures. Other suitable metallic materials that may be used include, but are not limited to, aluminum, titanium, a refractory metal, steel, stainless steel, Invar 36, Invar 42, a composite, a ceramic, carbon fiber or combinations thereof. These materials may exhibit such characteristics that allow the tubular body 115A to be manipulated under high temperature and then shrink wrapped around the super hard segments 103A. This process may be used in order to hold the super hard segments 103A under radial compression of 50-200% of operating pressure. Additionally, axial compression of 50-200% of proof pressure may be achieved through incorporation of a shoulder 105A at a first end 107A of the first bore 101A and a biasing unit (not shown) at a second end 109A. Although not limited to, the metallic material may be Invar 365 due to its comparative characteristics with polycrystalline diamond which allow both the first bore 101A formed in the tubular body 115A and second bore 102A formed by the aligned center holes 117A of the one or more super hard segments 103A to compliment one another in their utility and to further enhance the rigid composite structure's ability to retain its structural integrity during periods of high pressures and high temperatures.

Although the thickness of the super hard composite material forming the segments 103A may be comparable to the thickness of the metallic material forming the tubular body 115A, it should be noted that in embodiments where the rigid composite structure comprises a gun barrel, the preferred thickness for the super hard composite material forming the segments 103A is 0.040 inches to 0.25 inches, while the thickness of the metallic material forming the tubular body 115A is 0.25 inches to 0.75 inches. The thicknesses of the materials depends on many factors and any combination of thickness are covered within the scope of the claims.

Figure 5:
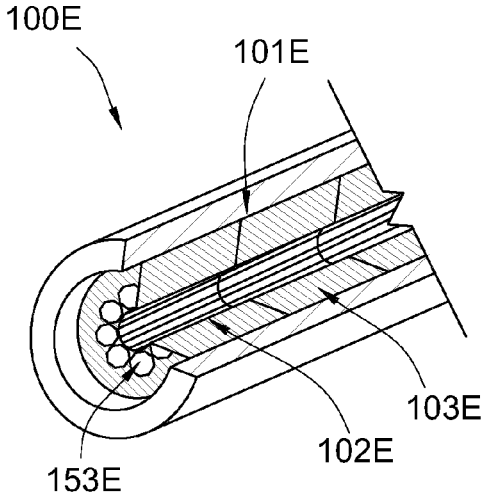
FIG. 5 is a perspective sectional diagram of another embodiment depicting a configuration of the super hard segments.

FIGS. 2-5 depict various configurations of the rigid composite structure 100B-100E having super hard segments 103B-103E that may comprise natural diamond, synthetic diamond, polycrystalline diamond, single crystalline diamond, or cubic boron nitride that may also incorporate a binder material of cobalt, niobium, titanium, zirconium, a refractory group metal or combinations thereof. Each segment 103B-103E may comprise a substantially annular shape (see FIG. 1), a substantially wedge shape, a substantially circular or semi-circular shape, substantially curved shape 150B (FIG. 2), a substantially hexagonal shape 151C (FIG. 3), a substantially rectangular shape 152D (FIG. 4), a substantially trapezoidal shape, or a substantially octagonal shape 153E (FIG. 5).

In a preferred method for manufacturing the super hard segments, diamond or cubic boron nitride grains are sintered in a high temperature high pressure press to form the desired shape of the segment. Usually a binder material is used to catalyze the sintering process, with a preferred binder material being cobalt, which diffuses under the high pressure and temperature from adjacent material (typically tungsten carbide) also in the press. In such a method, a bond will form between the adjacent tungsten carbide and the sintered diamond.

Figure 6:
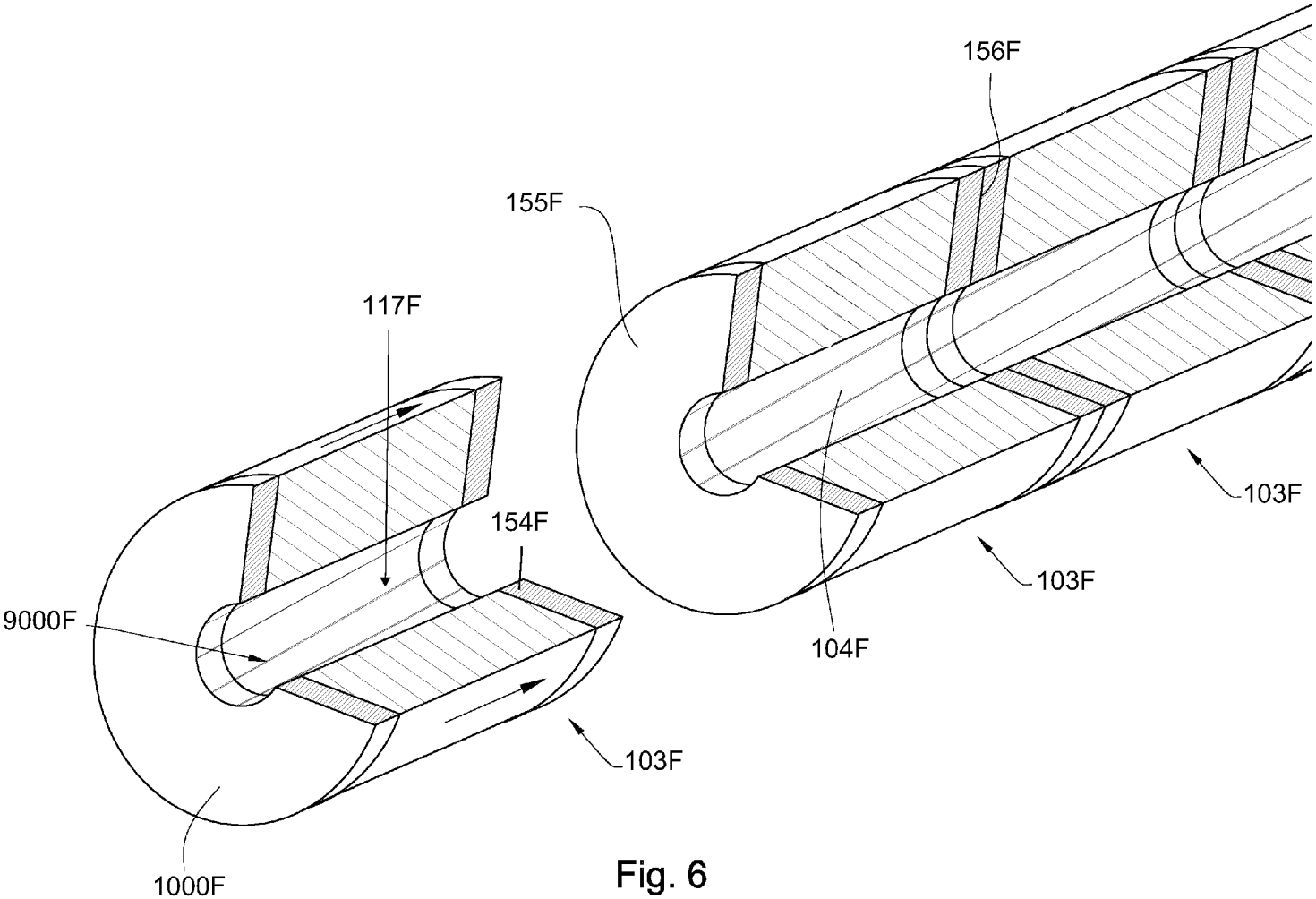
FIG. 6 is a perspective sectional diagram of another embodiment depicting a configuration for brazing segment interfaces.
Figure 7:
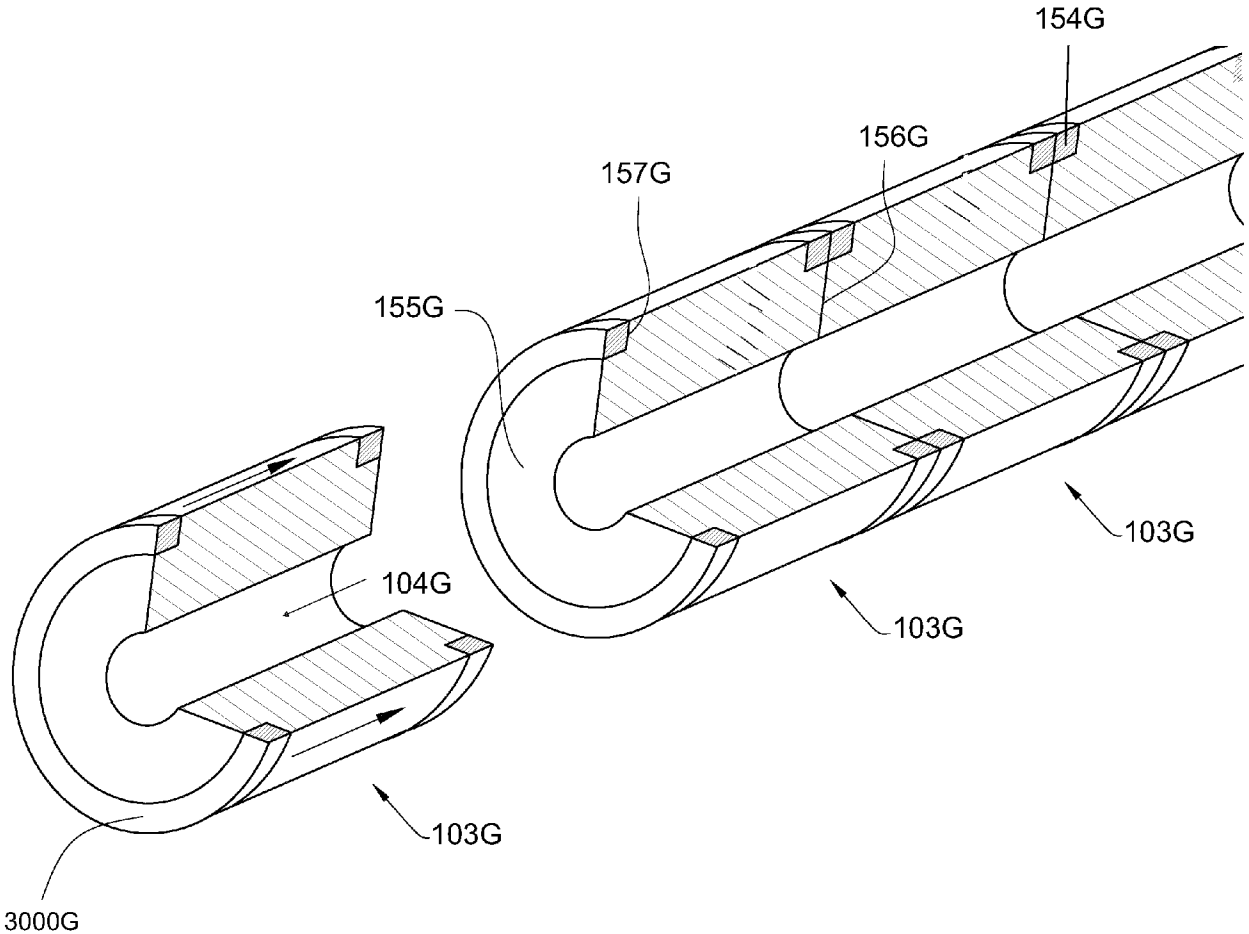
FIG. 7 is a perspective sectional diagram of another embodiment depicting another configuration for brazing segment interfaces.
Figure 8:
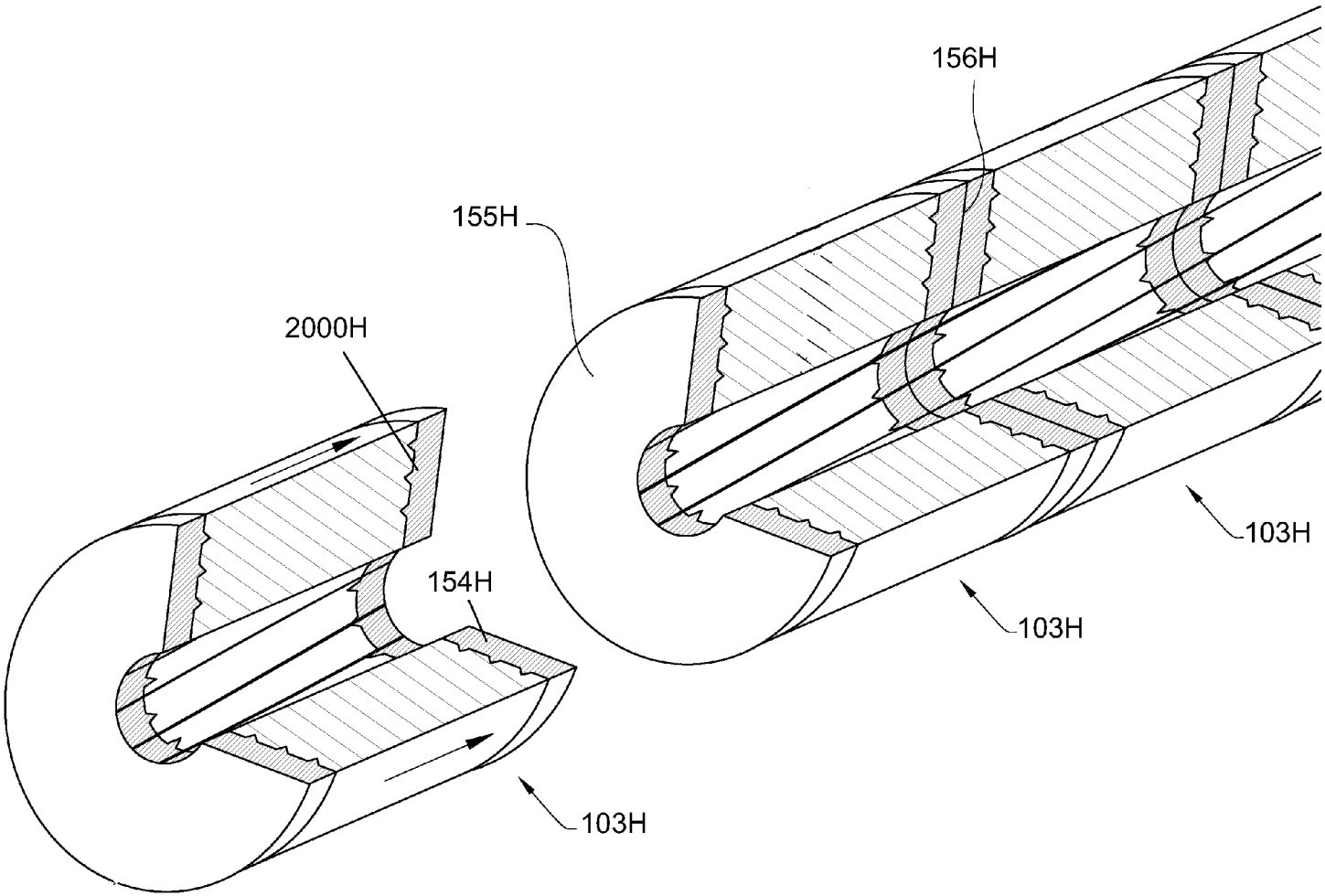
FIG. 8 is a perspective sectional diagram of another embodiment depicting another configuration for brazing segment interfaces.

FIGS. 6-8 depict the processes whereby the segments may be connected and held in place to form the second bore. Referring first to FIG. 6, the super hard segments 103F are brazed together using an interfacing material 154F that may comprise of gold, silver, a refractory metal, carbide, tungsten carbide, a cemented metal carbide, niobium, titanium, platinum, molybdenum or combinations thereof. Preferably, the interfacing material 154F is a tungsten carbide that has bonded to the super hard segment 103F during sintering. The abutting ends 155F and 156F, may be formed while still in the press. In FIG. 6, the abutting ends 155F, 156F comprise a flat surface or end face 1000F. In some embodiments a pattern 9000F may be formed in the interior surfaces 104F of the center holes 117F of the segments 103F while still in the press, such as the rifling patterns for embodiments where the rigid composite structure comprises a gun barrel.

FIG. 7 discloses an interfacing material 154G comprising an annular shape 3000G. The annular shape 3000G is bonded in a recess area 157G formed in the abutting ends 155G and 156G of the super hard segments 103G. The segments 103G may then be brazed together using the annular rings of interfacing material located on the abutting ends 155G, 156G of the segments 103G. In some embodiments, the super hard segments may be heat treated or annealed during and/or after they are brazed together, which may be advantageous since stresses created by brazing may be reduced or eliminated from the interior surfaces 104G. In some embodiments the segments may be annealed or heat treated after being formed in the press. In embodiments where a projectile or bullet is propelled through the rigid composite structure, the presence of a solid braze between interfacing materials 154G may increase friction. Also, the interfacing material 154G may thermally expand faster than the super hard segments 103G which may create stress in the interior surfaces 104G if an interfacing material is present.

FIG. 8 discloses a non-planar interface 2000H between the abutting ends 155H, 156H of the super hard segments 103H and the interfacing material 154H.

Figure 9:
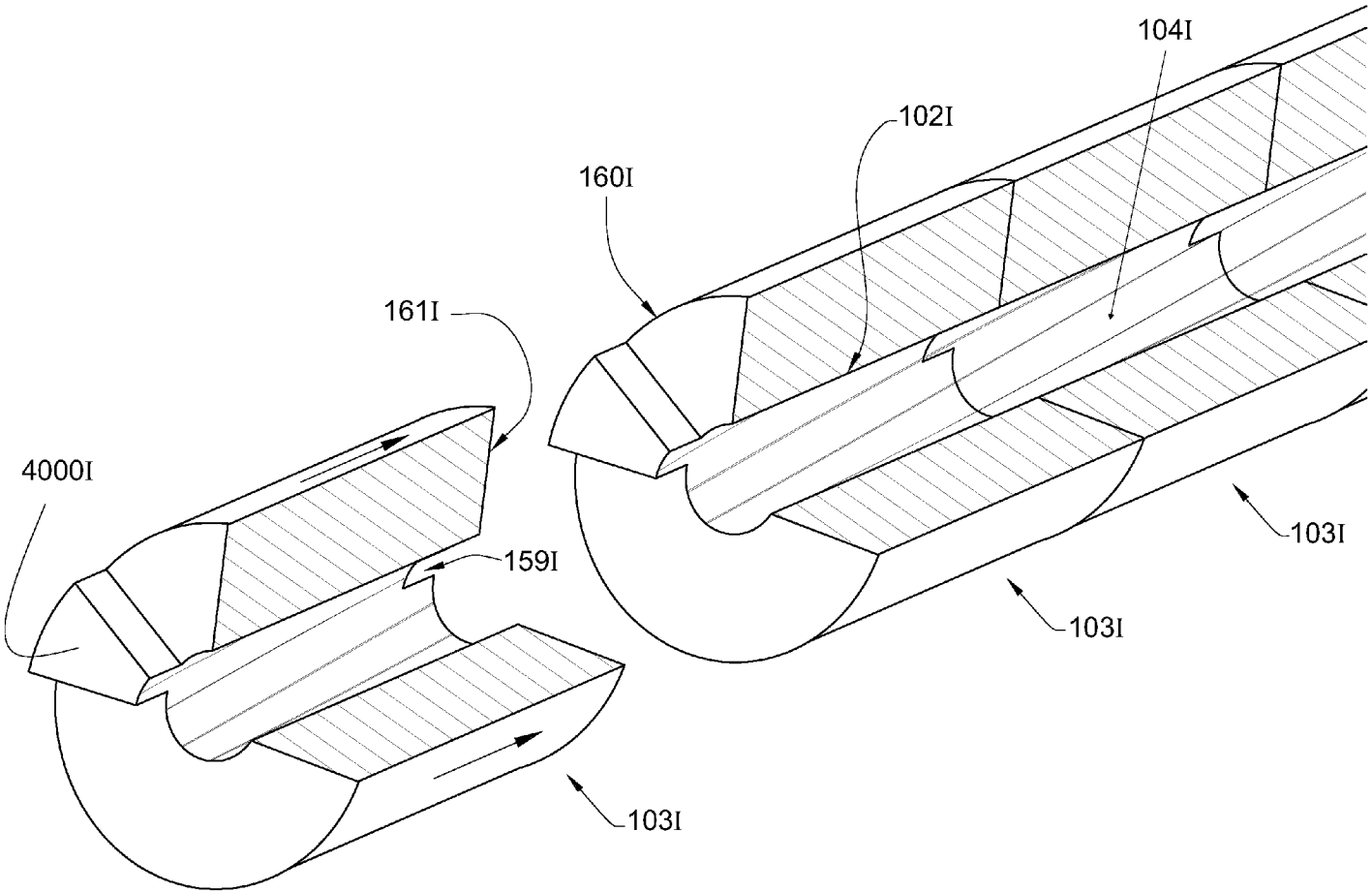
FIG. 9 is a perspective sectional diagram of another embodiment depicting interlocking configured segments.

FIG. 9 is a diagram of another embodiment of the rigid composite structure whereby the super hard segments 103I may be configured in such a way that they are joined by interlocking profiles. A first abutting end 160I may comprise a protrusion 4000I, which may be fitted within a socket 159I of a second abutting end 161I. In some embodiments, a plurality of protrusions 4000I and sockets 159I may be used. In other embodiments, the protrusion 4000I may comprise a pointed shape, a conical shape, a curved shaped, a rectangular shape, a pyramidal shape, or combinations thereof and the socket 159I matches the profile of the protrusion. This feature may be incorporated to further ensure that the segments 103I do not rotate within the first bore of the tubular body as a result of exposure to high temperatures and high pressures on the second bore 102I. This feature may prove especially useful if the present invention is adapted for use in the application of a gun barrel where movement of the segments may detrimentally affect the trajectory of a bullet as it exits the barrel, but which movement may be significantly reduced if interlocking abutting ends are incorporated in the formation of the second bore 102I as depicted. The interlocking profiles may also help to align the rifling formed in the interior surfaces 104I of the second bore 102I if the rifling is formed prior to connecting the superhard segments 103I.

Figure 10:
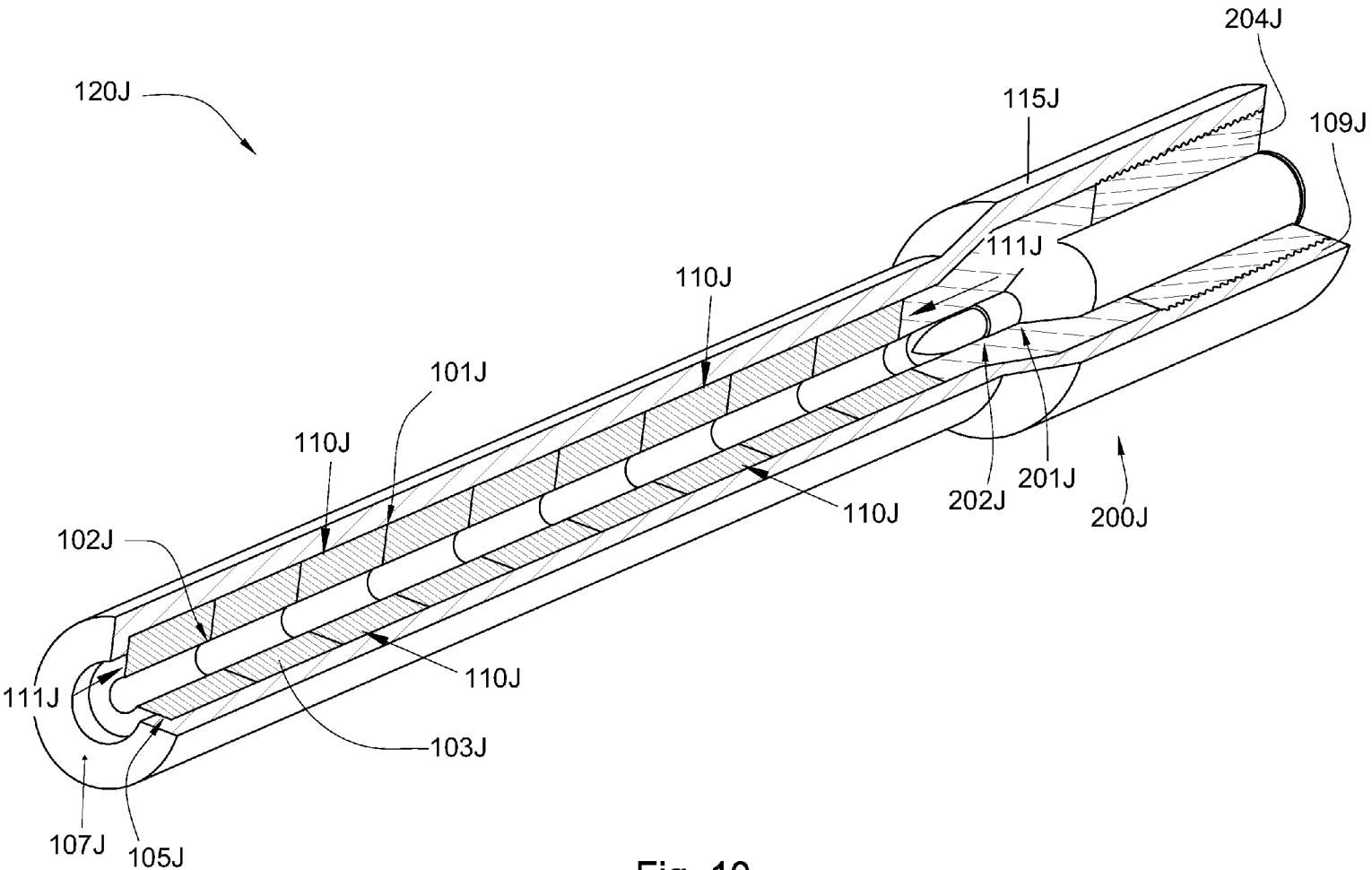
FIG. 10 is a perspective sectional diagram of another embodiment of a rigid composite structure.

FIG. 10 is a diagram of another embodiment of the rigid composite structure adapted for use as a gun barrel 120J. While the rigid composite structure may be described in connection with a gun barrel it should be noted that it is not restricted to this use and has multiple applications in any formation or construction as a rigid composite structure that retains its structural integrity during periods of high temperatures and high pressures. Other such structures may include piston cylinders, tubes or pipe.

The gun barrel 120J may comprise of a tubular body 115J made from a metallic material such as steel, and which tubular body includes a first bore 101J formed along a longitudinal axis thereof. A second bore 102J formed within an assembly of one or more super hard segments 103J, such as those preferably being made of polycrystalline diamond, may be disposed within the first bore 101J. The super hard segments may be held under radial compression, as depicted by arrows 110J, by the sidewalls of the tubular body 115J. The super hard segments may also be held under axial compression, as depicted by arrows 111J, between a shoulder 105J at a first or exit end 107J of the tubular body 115J and a breech component 200J at a second or breech end 109J.

Figure 17:
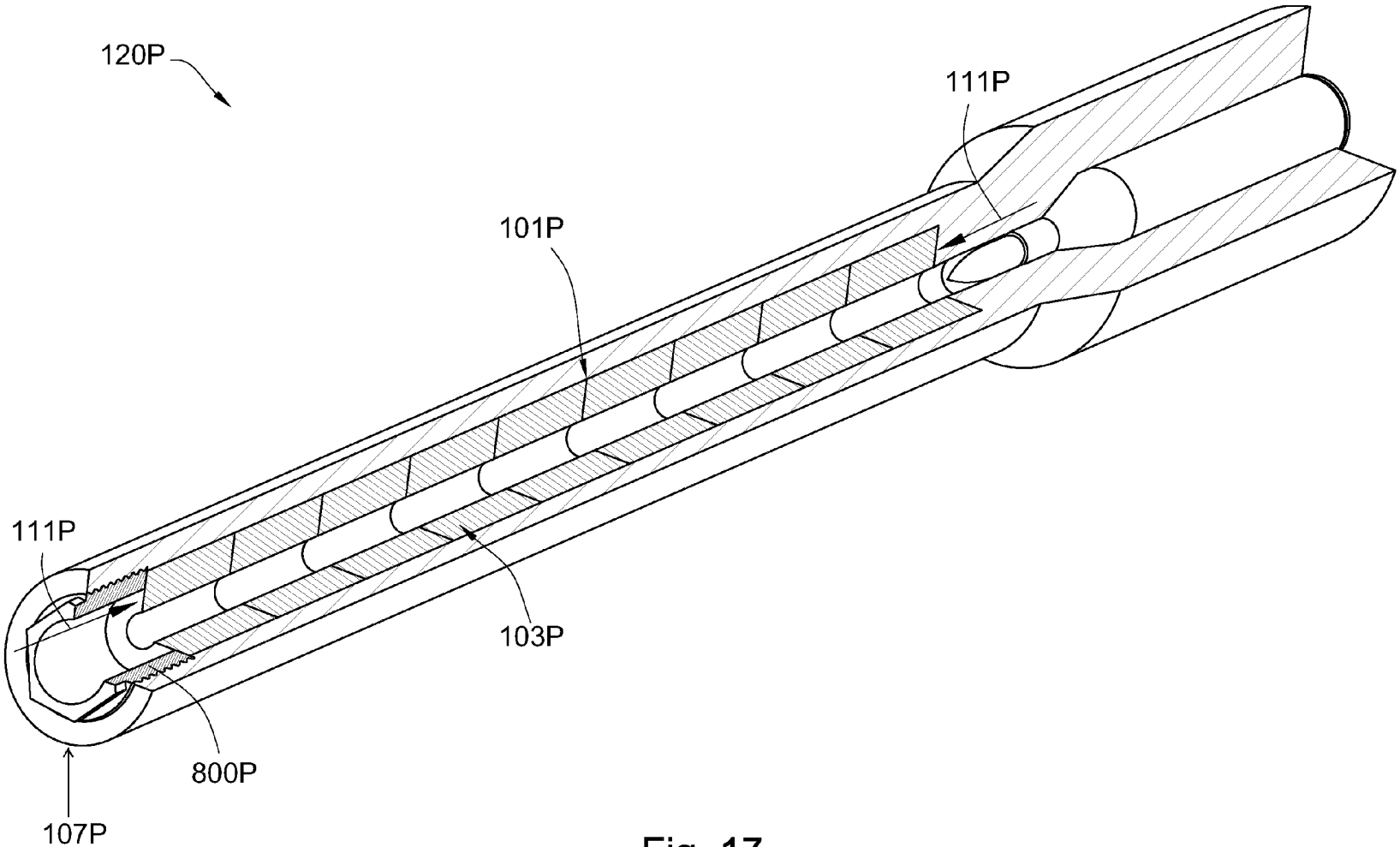
FIG. 17 is a perspective sectional diagram of another embodiment of the rigid composite structure depicting a threaded receiver.

A throat 201J and a free bore 202J may be made of a metallic material. A breech end 109J of the tubular body 115J may be threaded for reception of a threaded breech receiver 204J. The breech receiver 204J may be threaded into the second or breach end 109J of the tubular body 115J to apply the axial pressure. In some embodiments the exit end of the rigid composite structure may also be adapted to receive another threaded receiver which cooperates with the breech receiver to apply the axial compression to the one or more super hard segments (FIG. 17).

Figure 11:
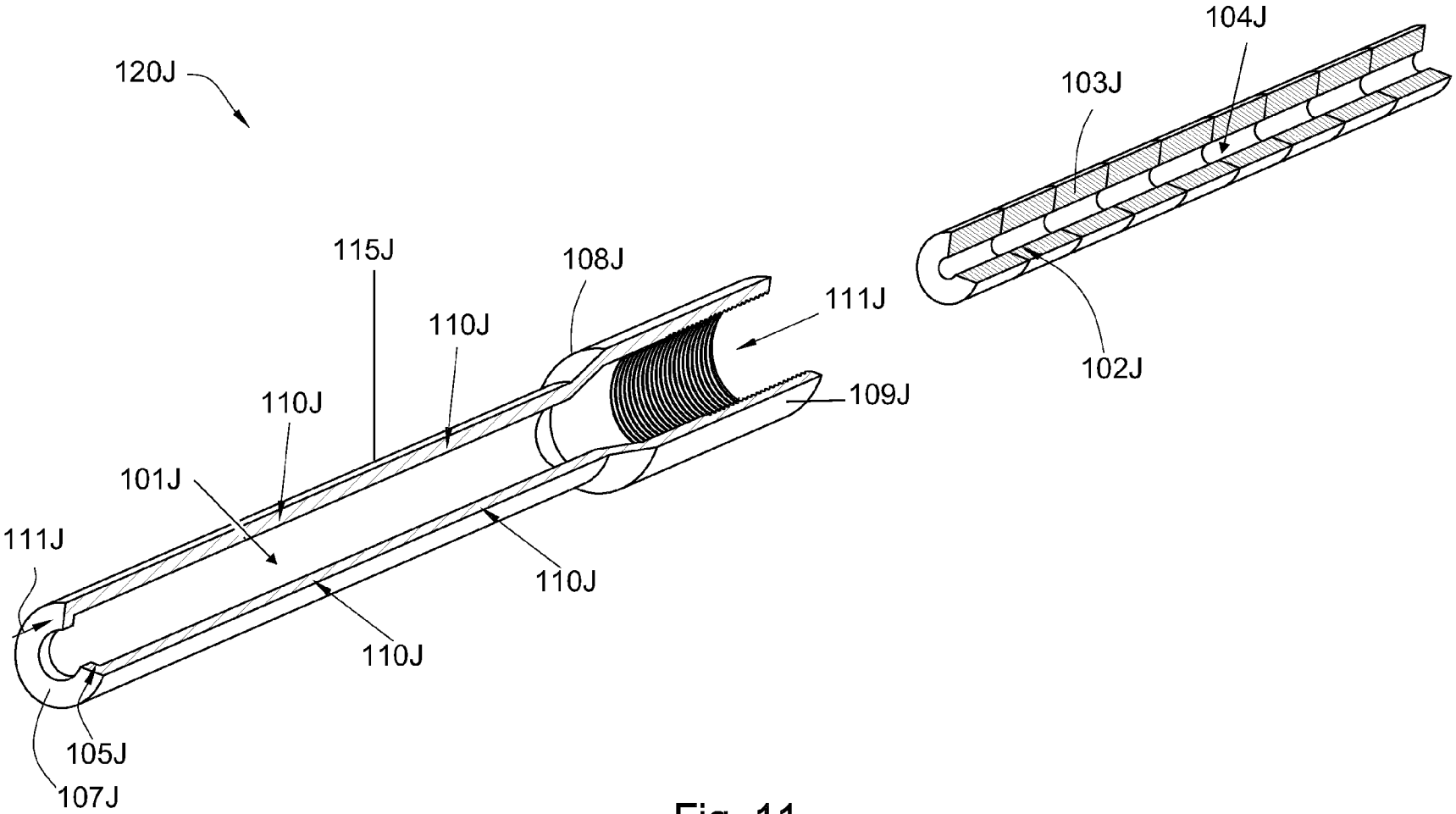
FIG. 11 is an exploded diagram of the rigid composite structure of FIG. 10.

FIG. 11 is an exploded diagram of the aforementioned embodiment of the rigid composite structure illustrated in FIG. 10 that is adapted for use as a gun barrel 120J. In some embodiments, the metallic material forming the tubular body 115J will be thermally expanded such that the one or more super hard segments 103J may be inserted into the first bore 101J as a single unit. In other embodiments, the segments 103J may be aligned within the first bore 101J. Invar 365 may be an ideal metallic material since it may expand significantly under very high temperatures, which would allow the first bore 101J of the tubular body 115J to be expanded for insertion of the segments. However, Invar 365 may not significantly expand under the range of temperatures that the interior surfaces 104J of the second bore 102J will be exposed to under rapid gun fire, thus allowing the sidewalls of the tubular body 115J to maintain radial compression 110J on the segments 103J. After the one or more super hard segments 103J are inserted into the first bore 101J of the tubular body 115J, the temperature of the metallic material forming the tubular body 115J may be lowered to shrink the first bore 101J about the segments 103J. In some embodiments, the intermediate material may be wrapped around the segments prior to their insertion into the first bore.

In some embodiments, the breech receiver 204J (FIG. 10) will be threaded into place in the breech end 109J of the first bore 101J after the tubular body 115J is sufficiently cooled. In other embodiments, the breech receiver 204 is not threaded, but is placed within the breech end 109J of the first bore 101J such that it biases the super hard segments 103J against the shoulder 105J at the first or exit end 107J, thereby applying an axial compression 111J. Then the temperature of the tubular body 115J is lowered, shrinking the first bore 101J around the breech receiver 204J such that the breech receiver is held in place within the first bore 101J after cooling and continues to apply axial compression 111J to the super hard segments. In yet other embodiments, the axial pressure 111J may be applied by a biasing unit 108J (FIG. 11) while the first bore 101J is expanded. The biasing unit 108J is then removed after the tubular body 115J is shrunk about the super hard segments 103J, and the friction between the first bore 101J and the segments is enough to provide the axial compression 111J.

Figure 12:
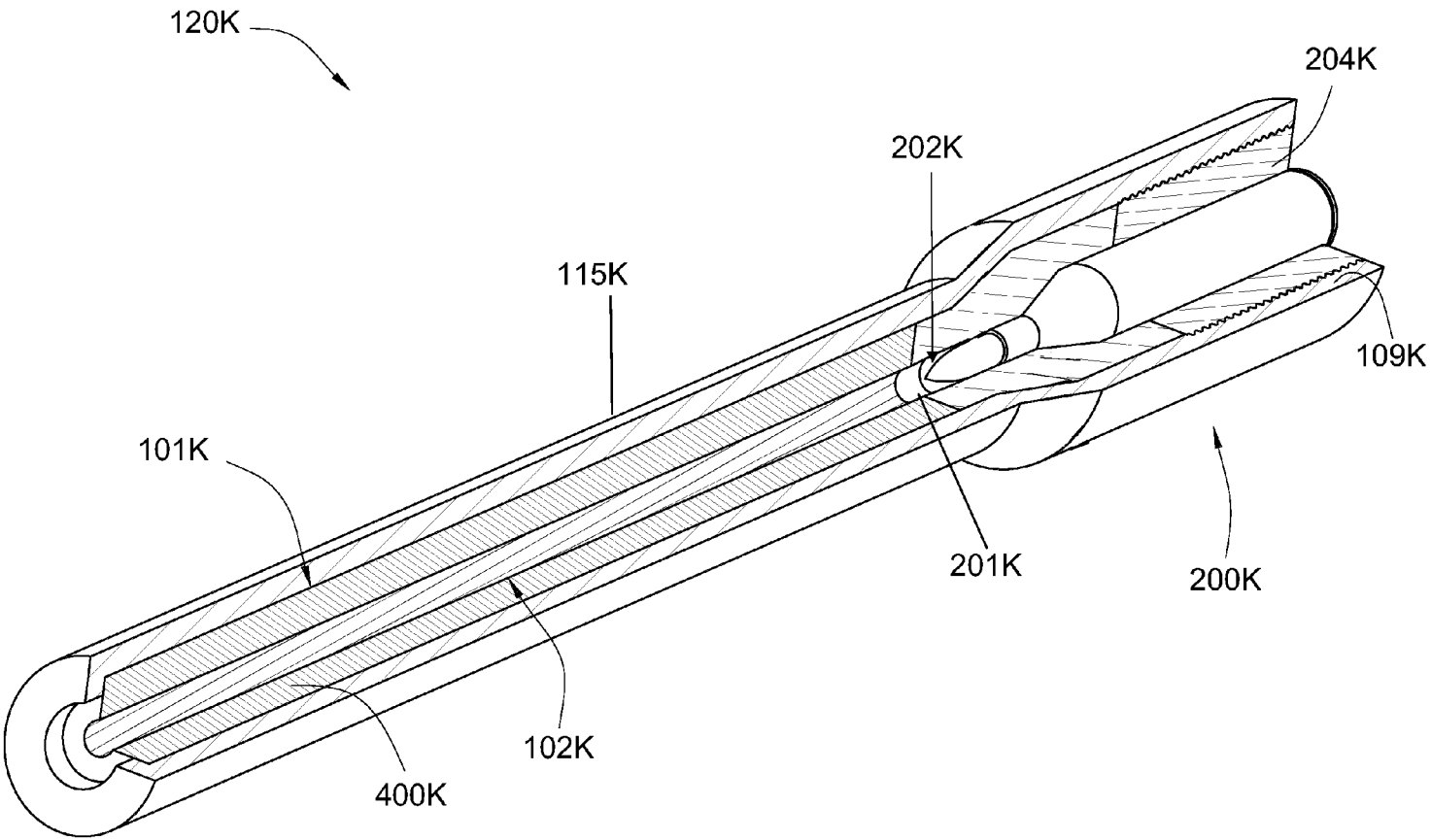
FIG. 12 is a perspective sectional diagram of another embodiment of the rigid composite structure depicting a single super hard segment.

FIG. 12 is a diagram of another embodiment of the rigid composite structure adapted for use as a gun barrel 120K, and depicts a variation in the formation of the second bore 102K, which may comprise the center hole 117A of a single super hard segment 400K installed within the first bore 101K of the tubular body 115K. The breech component 200K of the structure may comprise a throat 201K, a free bore 202K, a breech end 109K of the tubular body 115K and a breech receiver 204K, or combinations thereof, each of which may be made of a metallic material in whole or in part.

Figure 13:
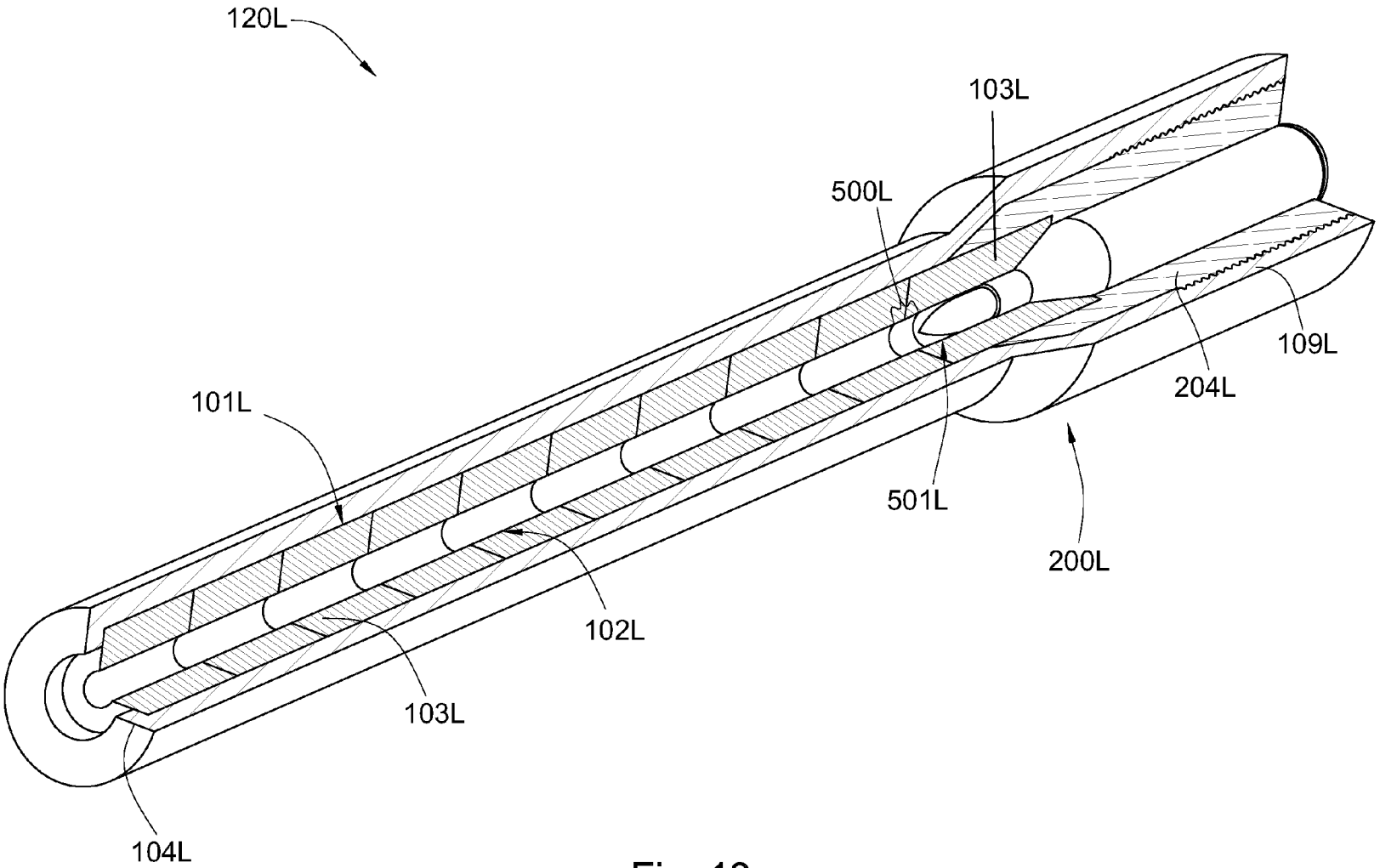
FIG. 13 is a perspective sectional diagram of another embodiment of the rigid composite structure depicting a throat and a free bore formed in a super hard composite material.

FIG. 13 is a diagram of another embodiment of the rigid composite structure adapted for use as a gun barrel 120K, and depicts a variation in the formation of the breech component 200L in which the throat 500L and free bore 501L are made of at least a portion of a super hard segment 103L. This may be advantageous since the throat 500L and the free bore 501L may be subjected to high amounts of wear.

Figure 14:
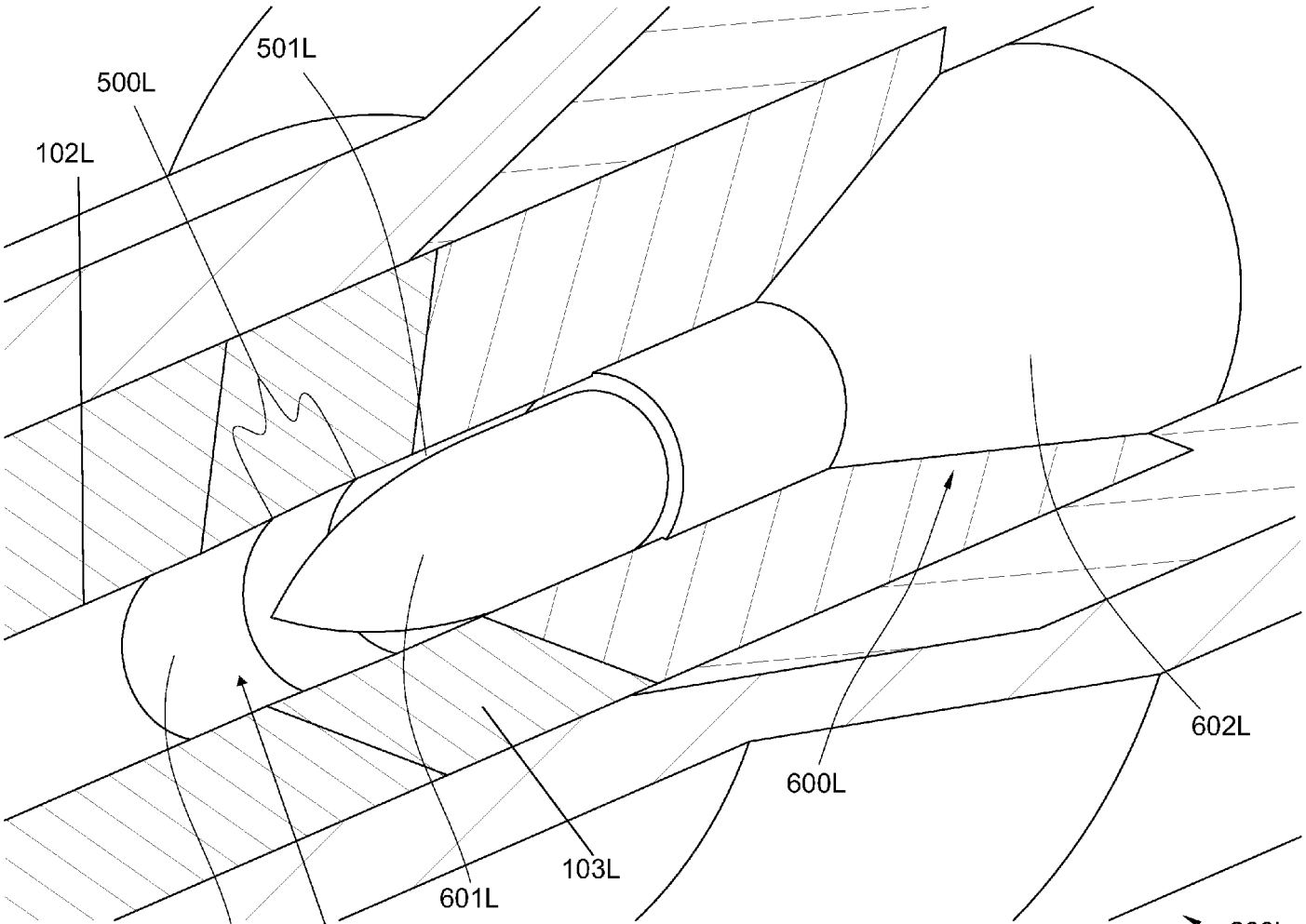
FIG. 14 is an enlarged view of the of the rigid composite structure of FIG. 13.

FIG. 14 is an enlarged view of the gun barrel 120L shown in FIG. 13 depicting the breech component 200L, including the throat 500L, which may be formed into the super hard interior surface 104L of a center hole 117L of a super hard segment 103L. A shoulder 600L may serve to hold a cartridge 602L in place and to prevent the cartridge 602L from entering the barrel. In some embodiments, the cartridge 602L may be rimmed, rimless and straight bored, or rimless and necked. The diagram also depicts the throat 500L and the free bore 501L being formed into at least one of the super hard segments 103L. The view depicts the throat 500L as it tapers inwardly until the diameter of the throat is substantially equal with the diameter of the second bore 102L of the gun barrel 120L. The throat 500L may assist to guide a bullet 601L into the second bore 102L of the gun barrel 120L.

Figure 15:
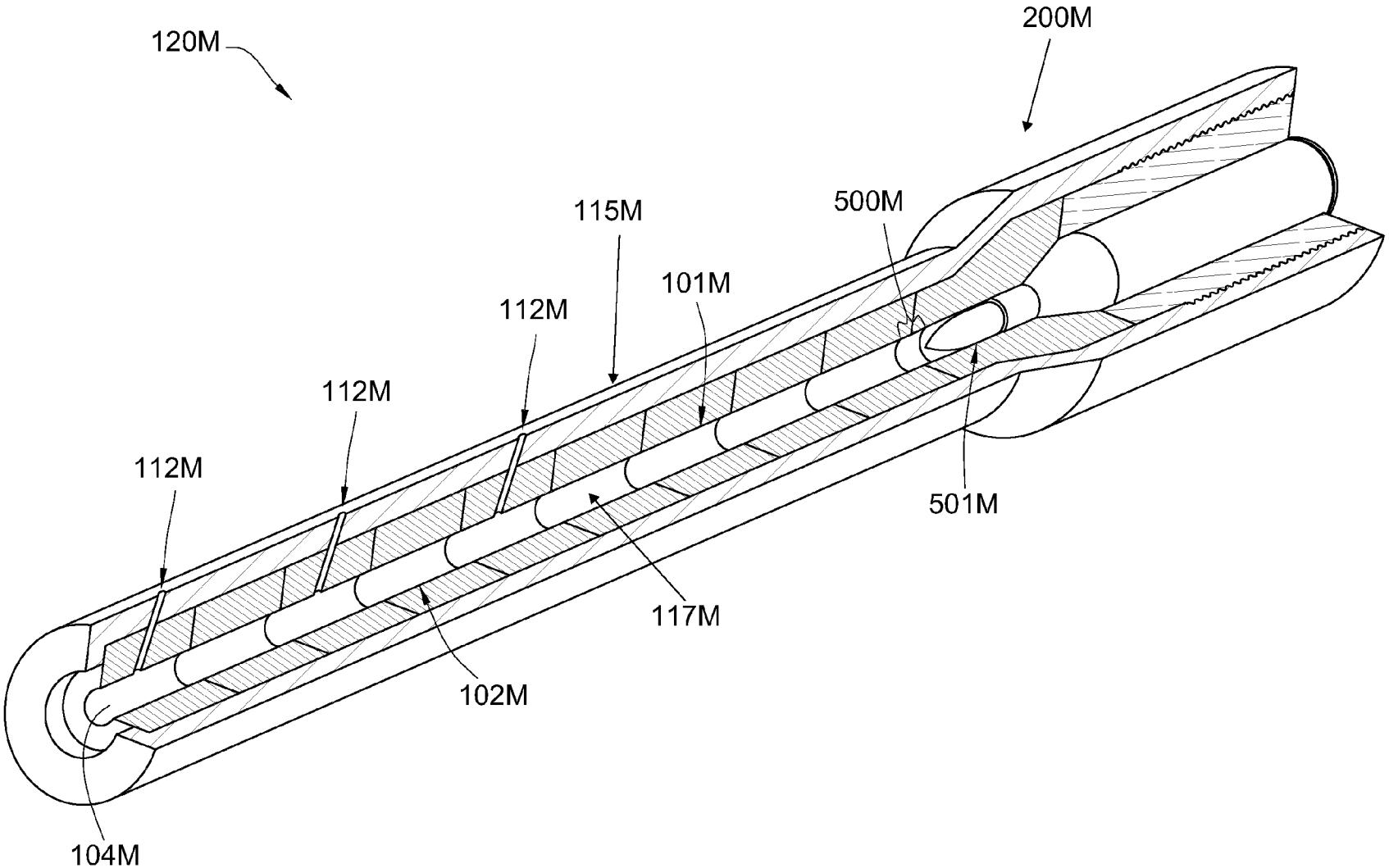
FIG. 15 is a perspective sectional diagram of another embodiment of the rigid composite structure depicting a throat and free bore formed in a super hard composite material.

FIG. 15 is a diagram of another embodiment of the rigid composite structure adapted for use as a gun barrel 120M, and depicts a variation in the formation of a breech component 200M in which a throat 500M and free bore 501M may be entirely formed within super hard composite materials. The embodiment also depicts one or more ports 112M extending through the tubular body 115M and the super hard segments

103M to the center holes 117M forming the second bore 102M, which ports 112M may help to counteract recoiling effects. The ports 112M may comprise a variety of geometries such as straight bores, tapered bores, rectangular bores, curved bores, angled bores, or combinations thereof. The ports may comprise a port axis that is normal to the longitudinal axis of the composite structure or the port access may intersect the longitudinal axis of the composite structure at any angle.

Figure 16:
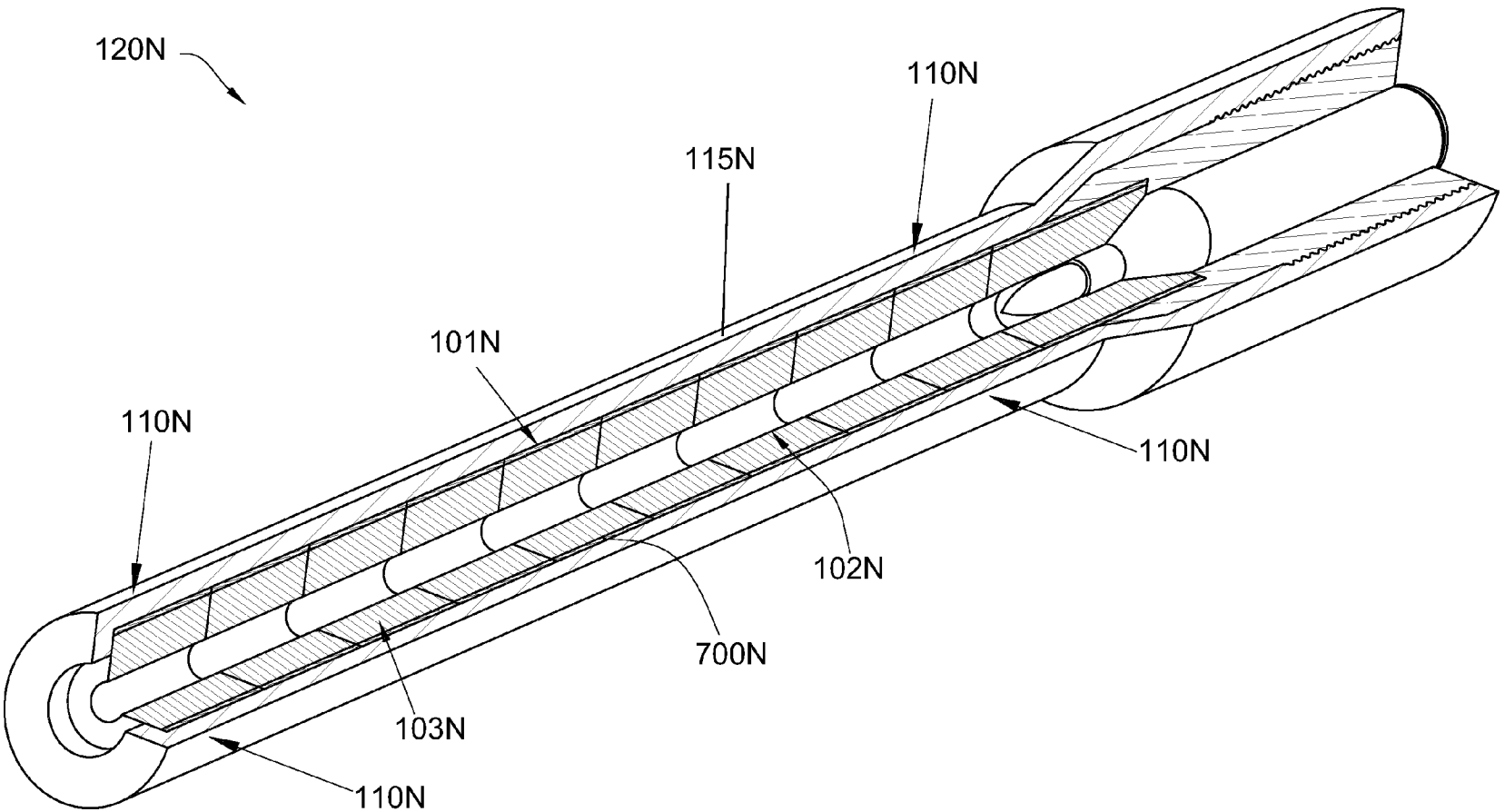
FIG. 16 is a perspective sectional diagram of another embodiment of the rigid composite structure depicting an intermediate layer.

FIG. 16 is a diagram of another embodiment of the rigid composite structure adapted for use as a gun barrel 120N. This embodiment may comprise of an additional intermediate layer 700N formed from a material with a low thermal expansion rate, such as Invar 36, Invar 42, and Invar 365, a composite, a ceramic, a refractory metal or carbon fiber, or combinations thereof. The intermediate layer 700N may be wrapped between the first bore 101N and the super hard segments 103N and serve as a thermal insulator to further enhance the structural integrity of the composite structure by assisting to contain the detrimental affects of heat on the composite structure. A thermal insulator may be advantageous in embodiments where the metallic material of the tubular body 115N would thermally expand within a temperature produced during gun fire, and which thermal insulator help prevent heat from reaching the first bore 101N, thereby allowing the radial compression 110N acting upon the super hard segments 103N to be maintained.

Further, an intermediate material with a low co-efficient of thermal expansion may also be used as the intermediate layer 700N. In such an embodiment, the intermediate layer 700N may comprise a high or low thermal conduction rate, but since the intermediate layer 700N may not expand even if the tubular body 115N does expand, the radial compression 110N on the super hard segments 103N may be maintained. Also, because the thermal conductivity of a super hard segment 103N made of diamond or cubic boron nitride is much higher than standard steels typically used for gun barrels, the friction encountered by a bullet traveling down the barrel may be lower, thus allowing for higher bullet velocities.

FIG. 17 is a diagram of another embodiment of the rigid composite structure adapted for use as a gun barrel 120P. This embodiment may comprise a threaded receiver 800P at the first or exit end 107P of the first bore 101P, and which threaded receiver 800P may serve to hold the super hard segments 103P in place and to apply axial compression 111P. The threaded receiver 800P may be comprise a material selected from the group consisting of aluminum, titanium, a refractory metal, steel, stainless steel, Invar 36, Invar 42, Invar 365, a composite, a ceramic and carbon fiber, and combinations thereof.

Figure 18:
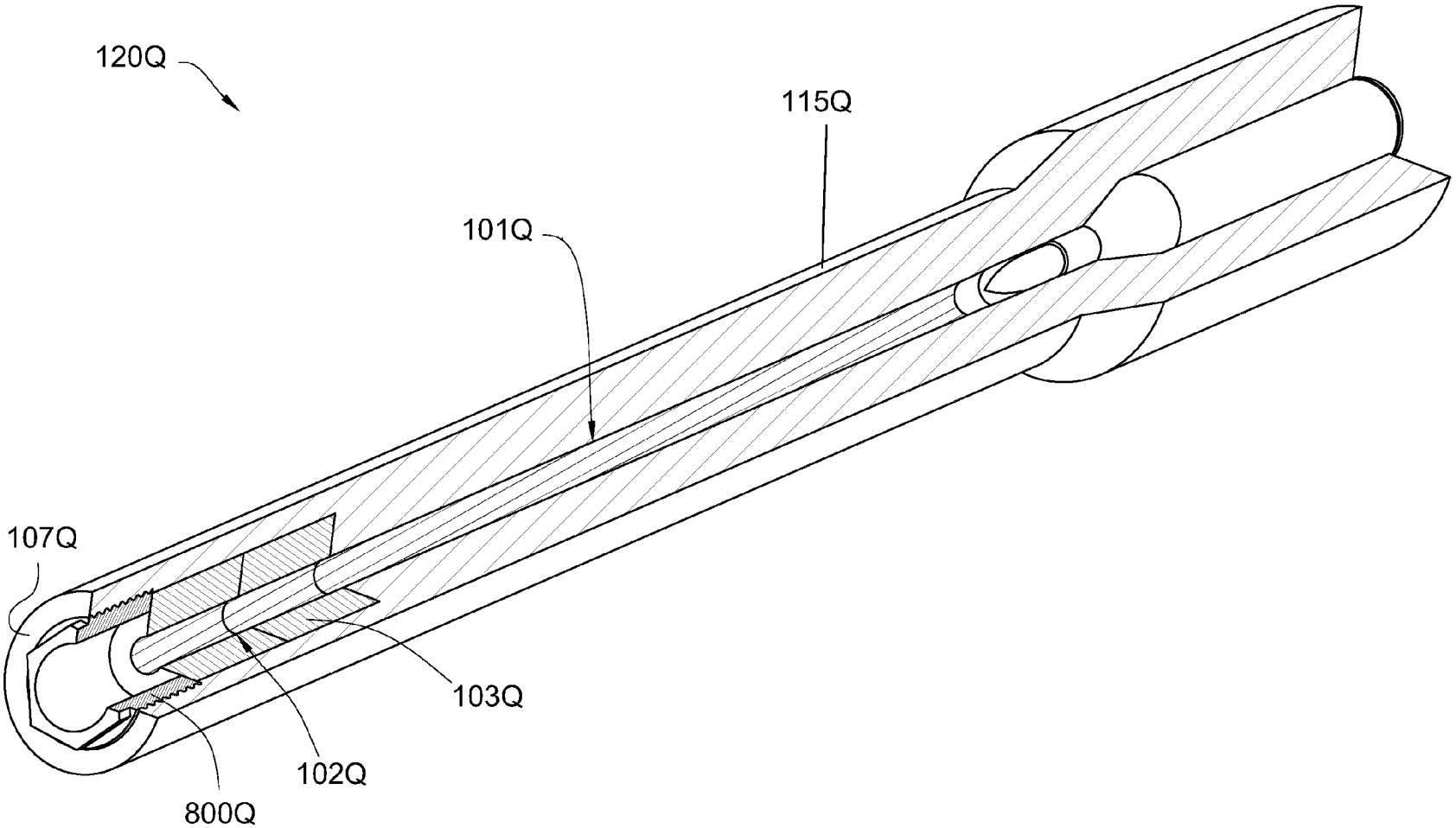
FIG. 18 is a perspective sectional diagram of another embodiment of the rigid composite structure depicting a portion of composite material with a threaded receiver.

FIG. 18 is a diagram of another embodiment of the rigid composite structure adapted for use as a gun barrel 120Q. This embodiment may comprise of a tubular body 115Q having a first bore 101Q, only a portion of which is lined with the one or more super hard segments 103Q, while still incorporating the threaded receiver 800Q at the first or exit end 107Q of first bore 101Q. The threaded receiver 800Q may bias the super hard segment or segments 103Q against an internal shoulder formed in the tubular body 115Q. Placing the super hard segments 103Q at the near the exit end 107Q of the barrel 120Q may be advantageous since gun barrels are subjected to a high amount of wear near their exit ends 107Q.

Figure 19:
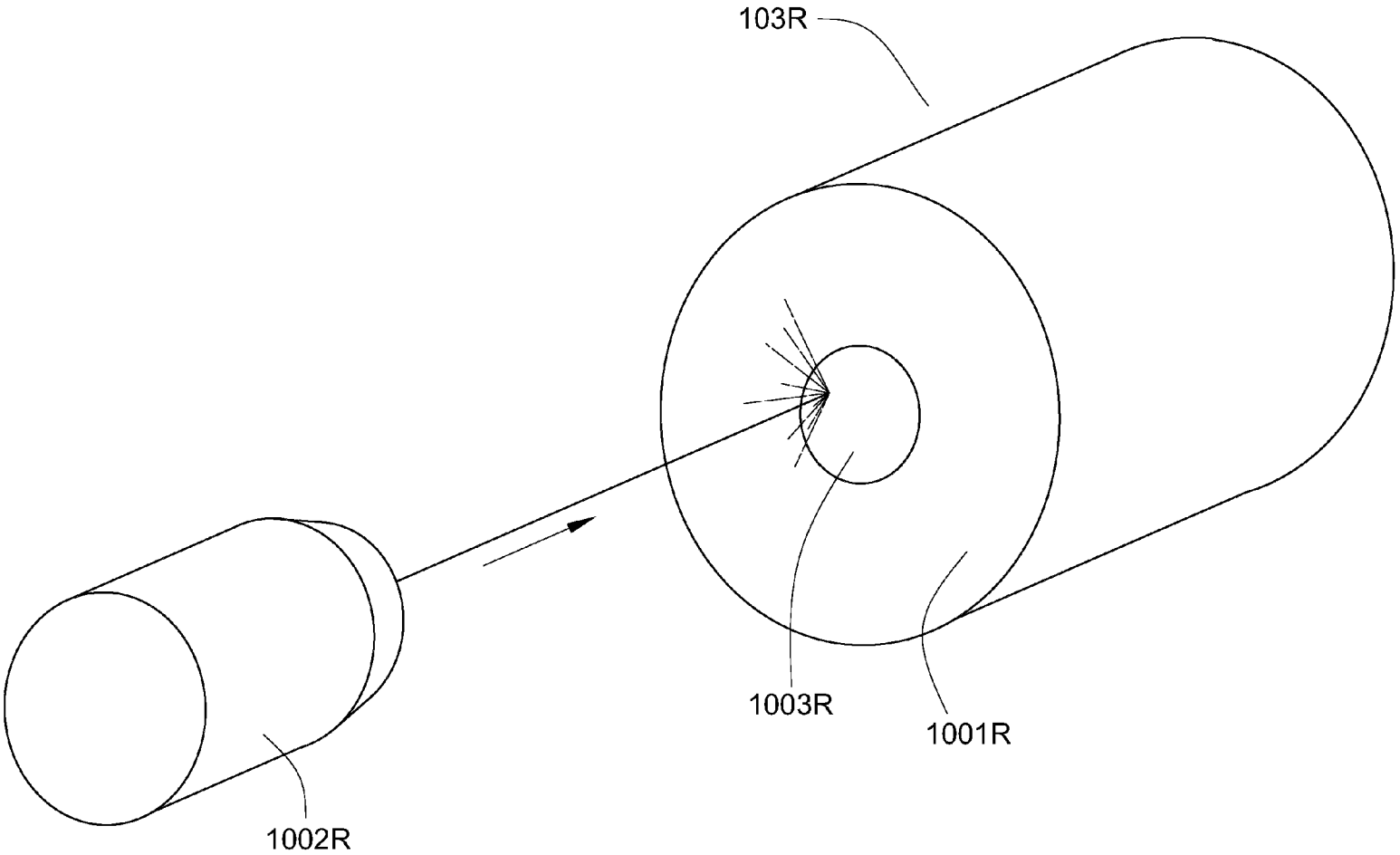
FIG. 19 is a schematic illustration of a method of subjecting a super hard segment to the electrode of an electric discharged machine (EDM).
Figure 20:
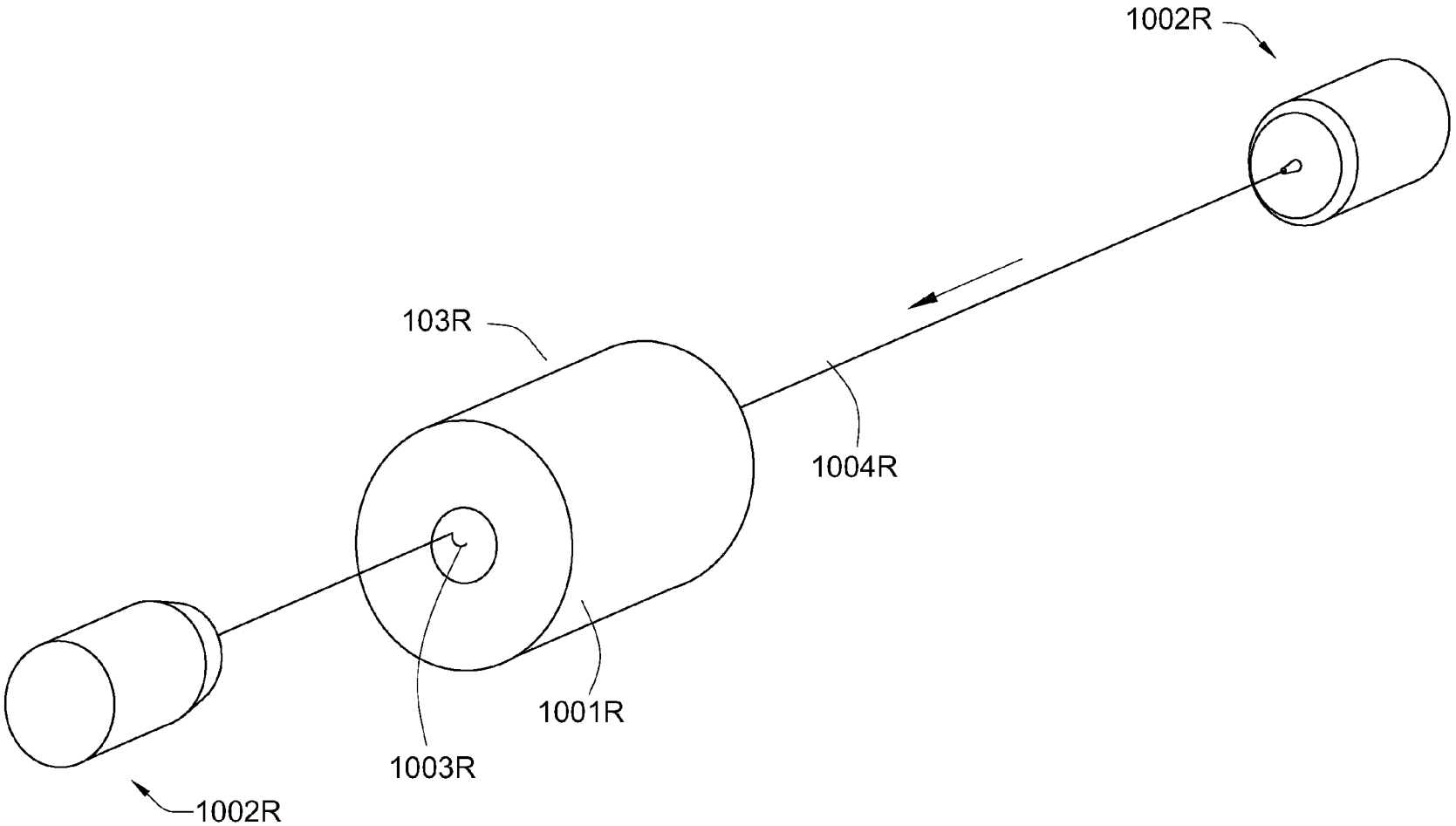
FIG. 20 is a schematic illustration of a method of cutting a super hard segment using an EDM wire.

FIGS. 19 and 20 are schematic illustrations depicting a method of manufacturing the super hard segments 103R. In such an embodiments, the segments 103R of the super hard composite material (preferable made of polycrystalline diamond) may be formed in a high temperature and high pressure press. The diamond grains are positioned within the press around a pillar 1003R of tungsten carbide which helps to mold the diamond segment into an annular shape. A binder may diffuse from the tungsten carbide into the diamond grains and act as a catalyst.

After the solid segment has been formed, the method may further comprise the use of an electrical discharge machine (EDM). An electrode 1002R of the EDM may be plunged into the solid segment 103R of super hard composite material 1001R to form a cavity which eventually results in the formation of the center hole having a super hard interior surface. After the cavity is initially formed from one end of the solid segment to the other end by the EDM electrode 1002R, an EDM wire 1004R may be threaded through the cavity (FIG. 20). This may be beneficial since particles of the super hard material are attracted to the EDM wire or electrode and may be removed from the segment 103R by pulling the wire 1004R through the cavity. Preferably, all of the pillar 1003R is removed such that there is substantially no tungsten carbide remaining in the super hard interior surface of the segment 103R. In other embodiments, a geometry of the superhard segments may be formed by abrasive lapping and/or abrasive grinding.

In some embodiments, the pillar may be lined with a high concentration of binder. In other embodiments a foil, such as a cobalt foil, may be wrapped around the pillar which may help in the diffusion of the binder into the diamond grains. In yet other embodiments a foil may be placed between the diamond grains and the pillar to prevent a creation of a strong bond between the two. Still in some embodiments, the pillar may be made of salt or the pillar may be lined with salt. A salt pillar with a foil of a desired binder wrapped around it may allow the formation of a strong annular segment with an easily removable pillar.

Figure 21:
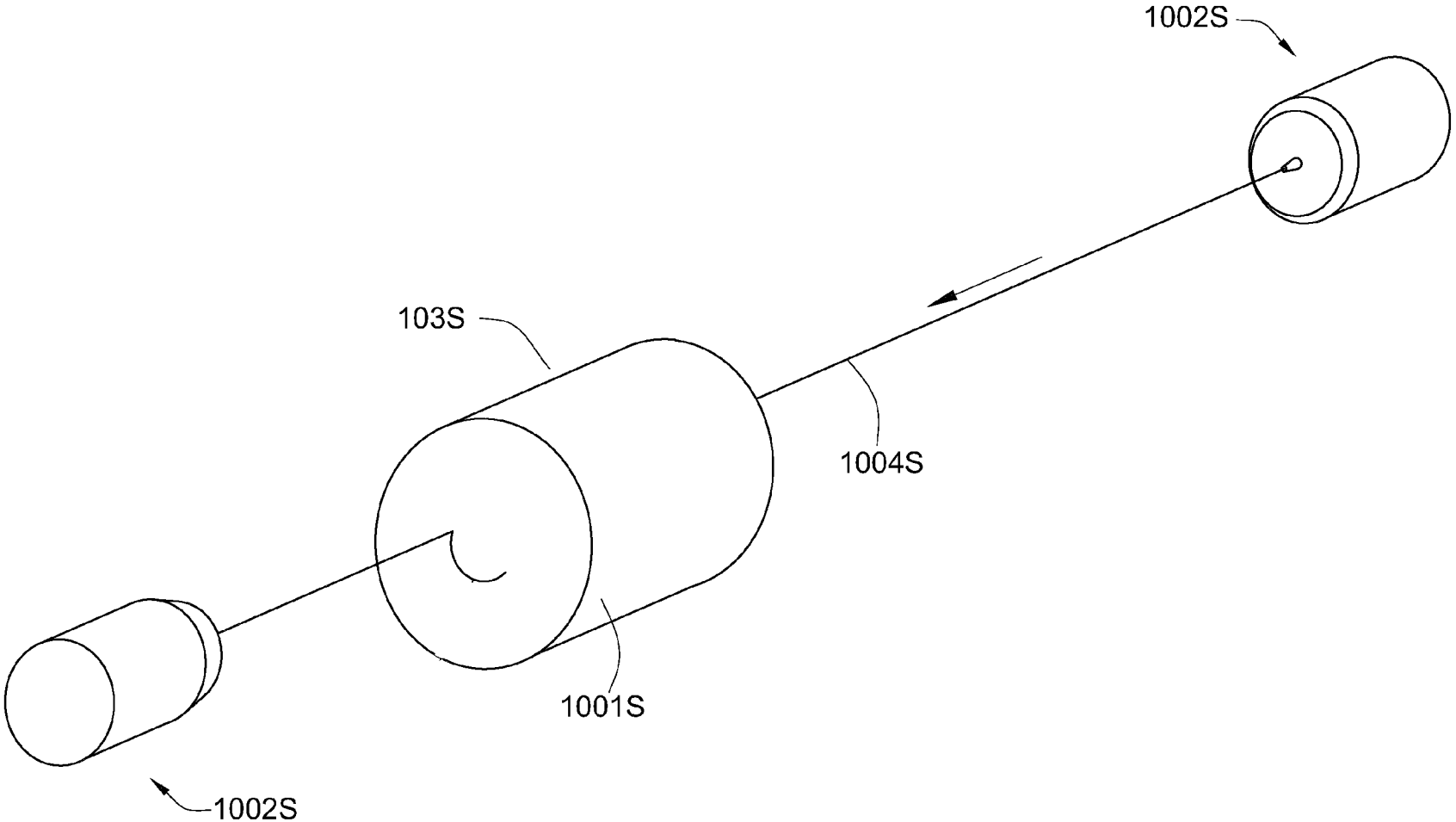
FIG. 21 is a schematic illustration of a method of cutting a super hard segment using an EDM wire.

FIG. 21 is a schematic illustration depicting another method of manufacturing the super hard segments 103S. The method differs from that shown in FIG. 20 in that the depicted super hard segment 103S is solid and has no pillar of another material disposed within it.

Figure 22:
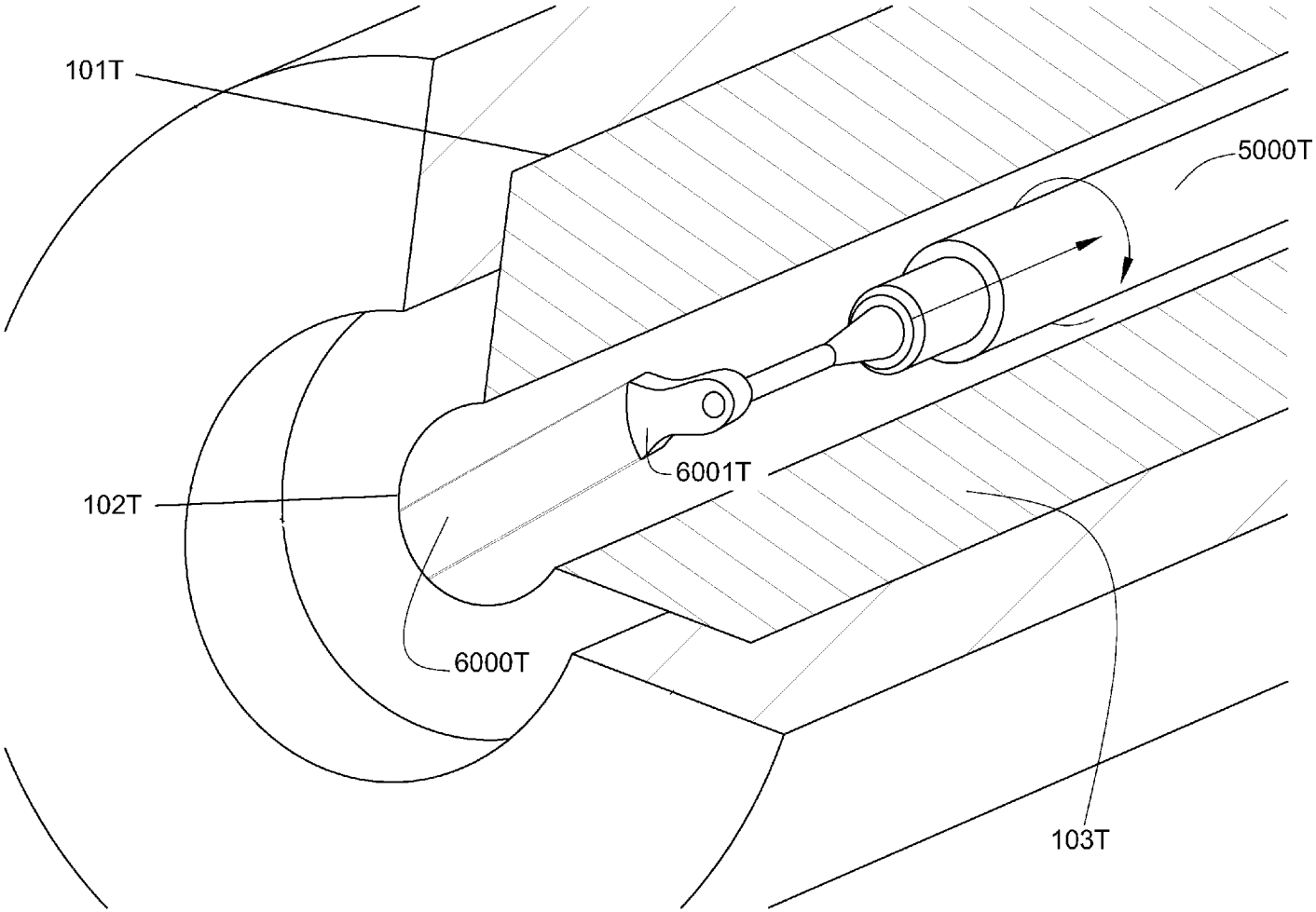
FIG. 22 is a perspective sectional diagram of a method of forming a pattern in the second bore using an EDM.
Figure 23:
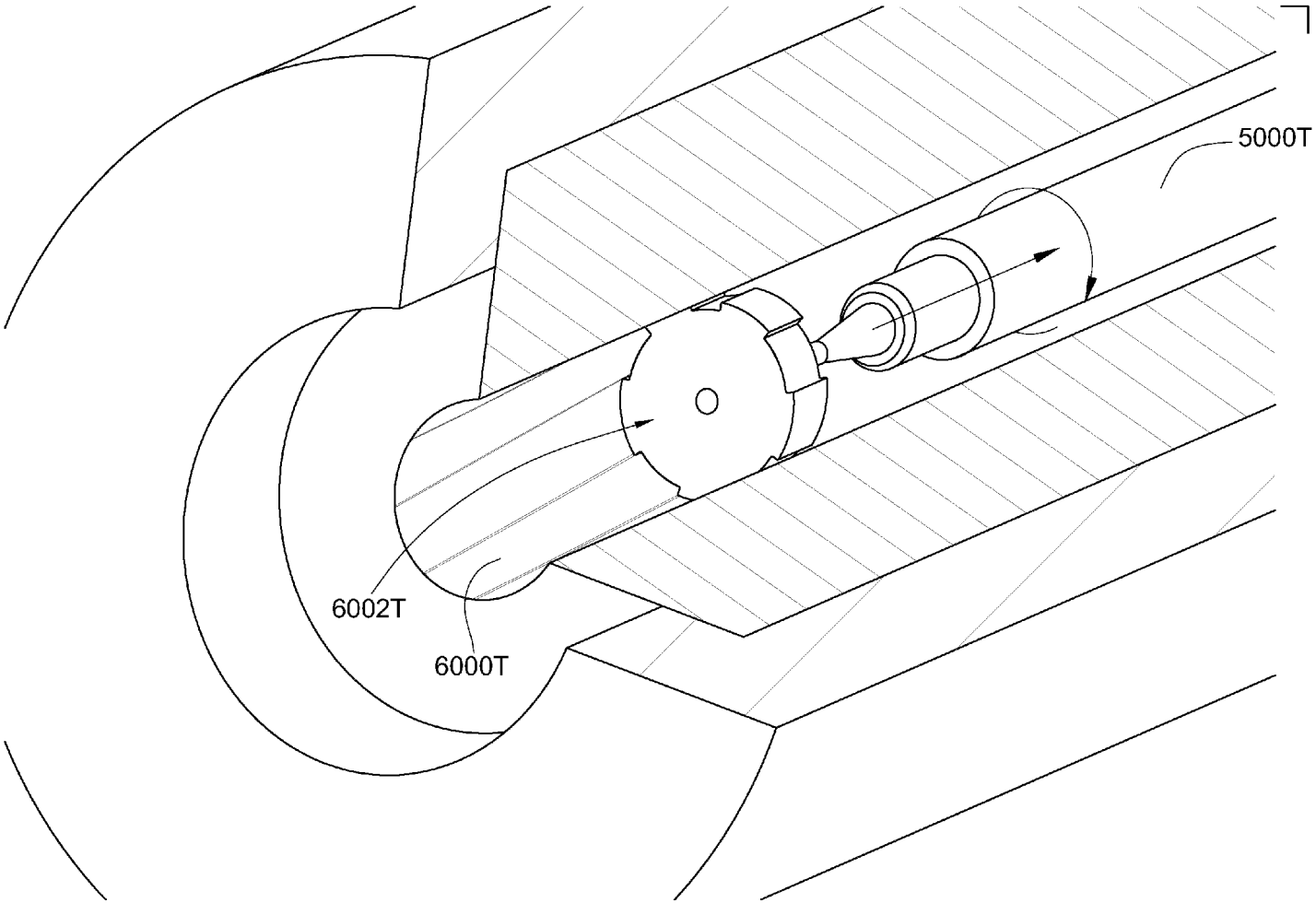
FIG. 23 is a perspective sectional diagram of another method of forming a pattern in the second bore using an EDM.

FIGS. 22 and 23 are perspective sectional diagrams of a method of forming a pattern in the second bore 102T of a gun barrel, each depicting a rifling process that may be incorporated using an EDM bit 5000T that is moved through the barrel and twisted either clockwise or counter-clockwise to form the desired rifling pattern 6000T using various cutting faces 6001T and/or 6002T.

Figure 24:
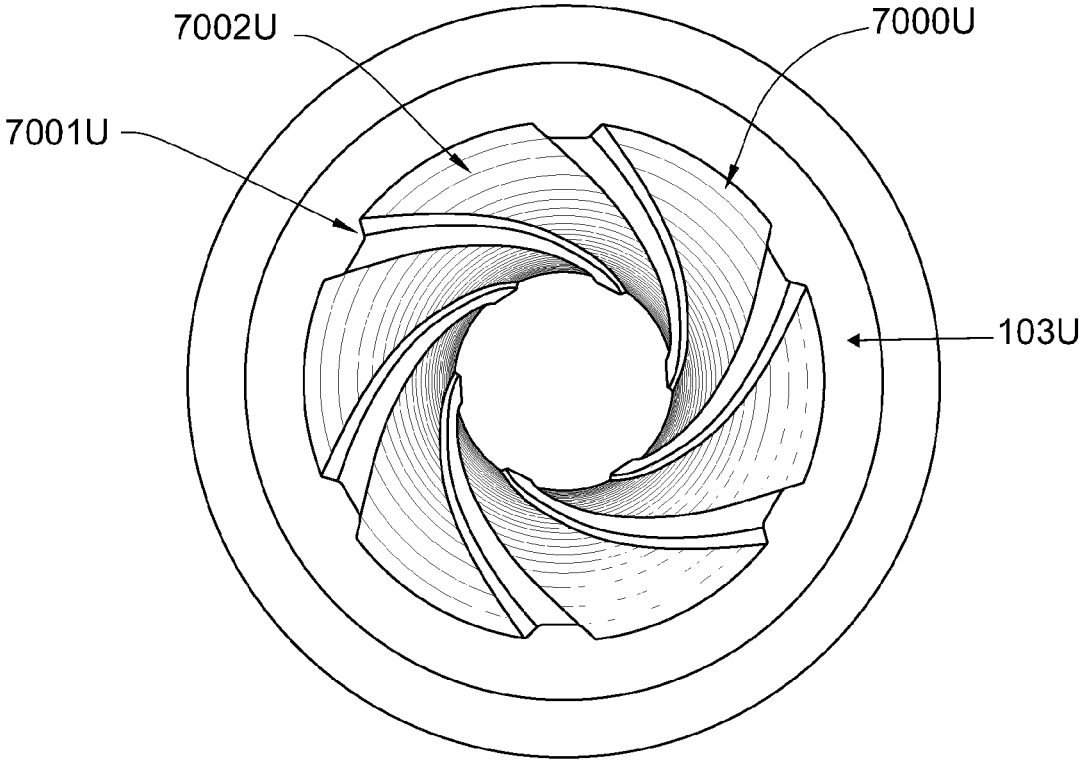
FIG. 24 is a perspective diagram of an embodiment of the rigid composite structure having a second bore formed with a land and groove rifling pattern.
Figure 25:
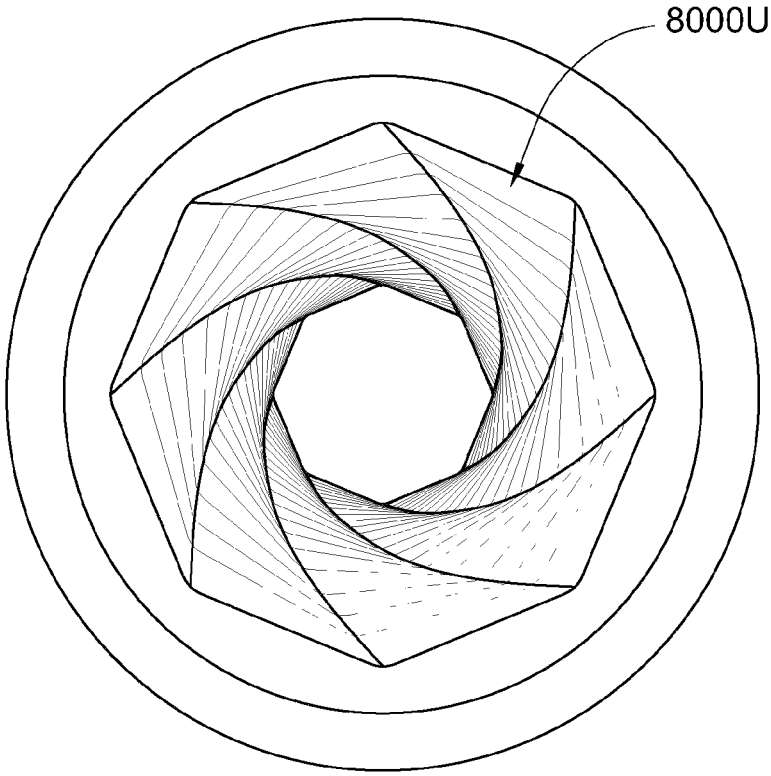
FIG. 25 is a perspective diagram of another embodiment of the rigid composite structure having a second bore formed with a polygonal rifling pattern.

FIGS. 24 and 25 disclose other embodiments of the rigid composite structure adapted for use as a gun barrel, and which depict a first and a second rifling pattern 7000U, 8000U, respectively. The first pattern 7000U comprises lands 7001U and grooves 7002U formed in the interior surfaces of the center holes of the super hard segments 103U. The second pattern 8000U comprises a polygonal shape. Both of these patterns may be formed with the aforementioned EDM. The rifling patterns may be incorporated to assist with the ballistics of a gun barrel as the bullet exits the barrel during ordinance use.

Patterns formed in the interior of other composite structures may also be formed using an EDM. It may be desirable that a piston comprise an anti-rotation protrusion and super hard segments lining the bore of the cylinder comprises a complementary slot coaxial with the piston for the protrusion to travel in.

Figure 26:
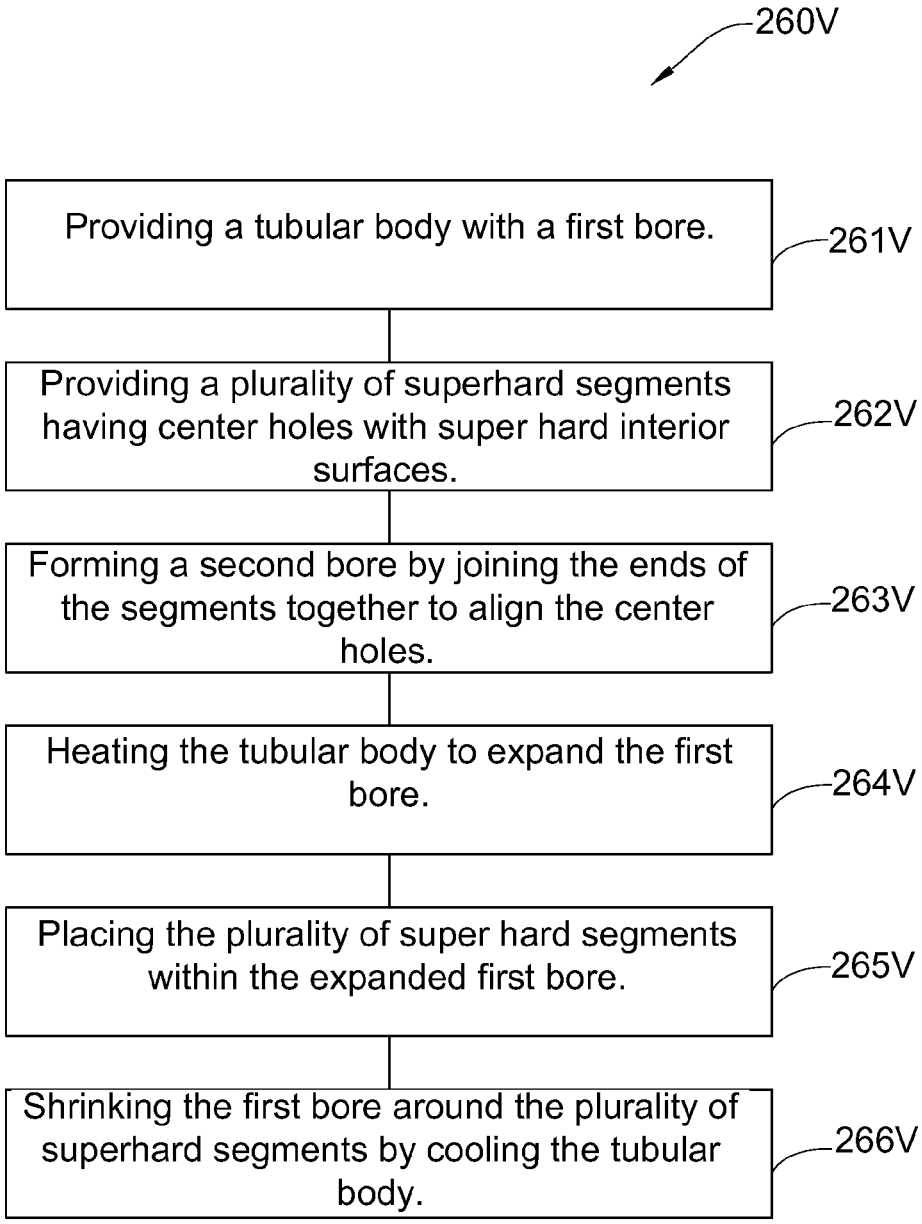
FIG. 26 is a flowchart illustrating a representative method for making of the rigid composite structure.

FIG. 26 is a flowchart illustrating a method 260V for manufacturing a rigid composite structure. The method comprises the steps of providing 261V a tubular body with a first bore, providing 262V a plurality of super hard segments having center holes with super hard interior surfaces, forming 263V a second bore by joining the ends of the segments together to aligning the center holes, heating 264V the tubular body to expand the first bore, placing 265V the plurality of super hard segments within the expanded first bore, and shrinking 266V the first bore around the plurality of super hard segments by cooling the tubular body.

Whereas the present invention has been described in particular relation to the drawings attached hereto, it should be understood that other and further modifications apart from those shown or suggested herein, may be made within the scope and spirit of the present invention.

What is claimed is:

1. A rigid composite structure, comprising:

a tubular body, the tubular body having a first end, a second end, a longitudinal axis, and a first bore formed along the longitudinal axis, the tubular body being formed from a metallic material; and a plurality of segments, each of the segments having a first end face, a second end face spaced from the first end face, a center hole extending through the first end face to the second end face, and being formed from a super hard material selected from the group consisting of natural diamond, synthetic diamond, polycrystalline diamond, single crystalline diamond and cubic boron nitride, the plurality of segments being disposed adjacent one another within at least a portion of the first bore and with the center holes of the segments being aligned along the longitudinal axis to form a second bore that is substantially co-axial with the first bore, the plurality of segments including:

at least one first segment having an interfacing material bonded to the super hard material at one of the first end face and the second end face, at least one second segment having an interfacing material bonded to the super hard material at the other of the first end face and the second end face, and the end faces having the interfacing material bonded thereto being abutted together and brazed together with the interfacing material.

2. The composite structure of claim 1, wherein the metallic material is selected from the group consisting of aluminum, titanium, a refractory metal, steel, stainless steel, a nickel steel alloy, a composite, a ceramic and carbon fiber.

3. The composite structure of claim 1, wherein the super hard material comprises a plurality of grains having a size of 0.1 to 300 microns.

4. The composite structure of claim 1, wherein the tubular body applies a radial compression to the plurality of segments.

5. The composite structure of claim 4, wherein the radial compression is provided by a shrink fit between the tubular body and the plurality of segments.

6. The composite structure of claim 1, wherein the super hard material further comprises a binder material selected from the group consisting of cobalt, niobium, titanium, zirconium, nickel, iron, tungsten, tantalum, molybdenum, silicon and a refractory group metal.

7. The composite structure of claim 6, wherein an interior surface of the center hole of at least one of the plurality of segments comprises a region depleted of the binder material.

8. The composite structure of claim 1, wherein the interfacing material is tungsten carbide bonded to the first end faces and the second end faces during a sintering process.

9. The composite structure of claim 1, wherein the second bore extends from the first end to the second end of the tubular body.

10. The composite structure of claim 1, further comprising each of the plurality of segments having an annular shape.

11. The composite structure of claim 1, further comprising at least one port extending through the plurality of segments from the second bore to an outer surface of the tubular body.

12. A rigid composite structure, comprising:

a tubular body, said tubular body being formed from a metallic material, said tubular body having a first end, a second end, a longitudinal axis, and a first bore formed along said longitudinal axis; and a plurality of segments, each of said segments being formed from a polycrystalline diamond material, each of said segments having a first end face, a second end face spaced from said first end face, and a center hole extending through said first end face to said second end face, said center hole having a low friction interior surface, said plurality of segments being abutted end face to end face and located within at least a portion of said first bore, said abutting end faces being brazed one to another with an interfacing material with said center holes of said segments being aligned about said longitudinal axis to form a second bore having a low friction interior surface, and with said second bore being substantially co-axial with said first bore.

13. The composite structure of claim 12, wherein said interfacing material is selected from the group consisting of gold, silver, a refractory metal, carbide, tungsten carbide, niobium, titanium, platinum, molybdenum, nickel palladium, cadmium, chromium, copper, silicon, zinc, lead, manganese, tungsten and platinum.

14. The composite structure of claim 12, wherein said interfacing material is bonded to said end faces prior to brazing said end faces to one another.

15. A rigid composite structure, comprising:

a tubular body, said tubular body having a first end, a second end, a longitudinal axis, and a first bore formed along said longitudinal axis, said tubular body being formed from a metallic material; and at least a first segment and a second segment, each of said segments having a first end face, a second end face spaced from said first end face, a center hole extending through said first end face to said second end face, and being formed from a super hard material selected from the group consisting of natural diamond, synthetic diamond, polycrystalline diamond, single crystalline diamond and cubic boron nitride, said first segment and second segments being located adjacent one another within at least a portion of said first bore and with said center holes being aligned along said longitudinal axis to form a second bore that is substantially co-axial with said first bore, said first segment and second segment including:

at least one of said first end face and said second end face of said first segment having an interfacing material bonded to said super hard material, at least one of said first end face and said second end face of said second segment being located proximate said end face of said first segment having said interfacing material bonded thereto, and said first segment and second segment being brazed together with said interfacing material.

16. The composite structure of claim 15, wherein said interfacing material is bonded to both of said first end face and said second end face of said first segment.

17. The composite structure of claim 15, wherein said interfacing material is bonded to at least one of said first end face and said second end face of said second segment.

18. The composite structure of claim 17, further comprising said end faces of said first segment and said second segment having said interfacing material bonded thereto being abutted together and brazed together with said interfacing material.

* * * * *